US007731580B2

(12) United States Patent
Rothkranz

(10) Patent No.: US 7,731,580 B2
(45) Date of Patent: Jun. 8, 2010

(54) GAMING DEVICE WITH MULTIPLE ORBIT AWARD INDICATOR

(75) Inventor: Markus Rothkranz, Las Vegas, NV (US)

(73) Assignee: IGT, Reno, NV (US)

( * ) Notice: Subject to any disclaimer, the term of this patent is extended or adjusted under 35 U.S.C. 154(b) by 1501 days.

(21) Appl. No.: 10/958,494

(22) Filed: Oct. 4, 2004

(65) Prior Publication Data

US 2006/0073867 A1 Apr. 6, 2006

(51) Int. Cl.
*A63F 9/24* (2006.01)
*A63F 13/00* (2006.01)

(52) U.S. Cl. ..... 463/16; 463/20; 273/143 R

(58) Field of Classification Search ..... 463/16–20, 463/25, 40–42; 273/138.1, 143 R, 139, 274, 273/292; 713/181, 187; 380/251, 255, 28
See application file for complete search history.

(56) References Cited

U.S. PATENT DOCUMENTS

| | | | |
|---|---|---|---|
| 2,545,644 | A | 3/1951 | Benton et al. |
| 3,975,022 | A | 8/1976 | Figueroa |
| 4,321,673 | A | 3/1982 | Hawwass et al. |
| 4,410,178 | A | 10/1983 | Partridge |
| 4,695,053 | A | 9/1987 | Vazquez, Jr. et al. |
| 4,732,386 | A | 3/1988 | Rayfiel |
| 4,775,155 | A | 10/1988 | Lees |
| 5,046,737 | A | 9/1991 | Fienberg |
| 5,102,137 | A | 4/1992 | Ekiert |
| 5,152,529 | A | 10/1992 | Okada |
| 5,205,555 | A | 4/1993 | Hamano |
| 5,342,047 | A | 8/1994 | Heidel et al. |
| 5,364,100 | A | 11/1994 | Ludlow et al. |
| 5,395,111 | A | 3/1995 | Inoue |
| 5,449,173 | A | 9/1995 | Thomas et al. |
| 5,536,016 | A | 7/1996 | Thompson |
| 5,560,603 | A | 10/1996 | Seelig et al. |
| 5,584,763 | A | 12/1996 | Kelly et al. |
| 5,611,535 | A | 3/1997 | Tiberio |
| 5,664,998 | A | 9/1997 | Seelig et al. |
| 5,766,074 | A | 6/1998 | Cannon et al. |

(Continued)

FOREIGN PATENT DOCUMENTS

| | | |
|---|---|---|
| GB | 371199 | 4/1932 |

(Continued)

OTHER PUBLICATIONS

Classic Pot of Gold advertisement written by Ace Coin Equipment Ltd., available prior to Oct. 4, 2004.

(Continued)

*Primary Examiner*—Peter DungBa Vo
*Assistant Examiner*—Masud Ahmed
(74) *Attorney, Agent, or Firm*—K&L Gates LLP

(57) ABSTRACT

A gaming device having a display with an award indicator that moves in multiple orbits is provided. A member rotates about a first center point at a first radial distance from the first center point. An indicator rotates about a second center point located on the member at a second radial distance from the second center point. When the indicator stops moving, the indicator points to or indicates an award that is provided to a player of the gaming device.

39 Claims, 15 Drawing Sheets

U.S. PATENT DOCUMENTS

| | | | |
|---|---|---|---|
| 5,788,573 | A | 8/1998 | Baerlocher et al. |
| 5,823,872 | A | 10/1998 | Prather et al. |
| 5,823,874 | A | 10/1998 | Adams et al. |
| D400,597 | S | 11/1998 | Hedrick et al. |
| D402,702 | S | 12/1998 | Seelig et al. |
| 5,848,932 | A | 12/1998 | Adams |
| 5,851,148 | A | 12/1998 | Brune et al. |
| 5,855,514 | A | 1/1999 | Kamille |
| 5,873,781 | A | 2/1999 | Keane |
| D406,865 | S | 3/1999 | Heidel |
| 5,882,261 | A | 3/1999 | Adams |
| 5,911,418 | A | 6/1999 | Adams et al. |
| 5,927,714 | A | 7/1999 | Kaplan |
| 5,947,820 | A | 9/1999 | Morro et al. |
| 5,976,015 | A | 11/1999 | Seelig et al. |
| 5,984,781 | A | 11/1999 | Sunaga |
| 5,996,997 | A | 12/1999 | Kamille |
| 5,997,401 | A | 12/1999 | Crawford |
| 6,004,207 | A | 12/1999 | Wilson, Jr. et al. |
| 6,015,346 | A | 1/2000 | Bennett |
| 6,033,307 | A | 3/2000 | Vancura |
| 6,059,289 | A | 5/2000 | Vancura |
| 6,059,658 | A | 5/2000 | Mangano et al. |
| 6,086,066 | A | 7/2000 | Takeuchi et al. |
| 6,089,976 | A | 7/2000 | Schneider et al. |
| 6,089,977 | A | 7/2000 | Bennett |
| 6,089,978 | A | 7/2000 | Adams et al. |
| 6,102,798 | A | 8/2000 | Bennett |
| 6,105,962 | A | 8/2000 | Malavazos et al. |
| 6,113,098 | A | 9/2000 | Adams |
| 6,126,542 | A | 10/2000 | Fier |
| 6,142,873 | A | 11/2000 | Weiss et al. |
| 6,142,874 | A | 11/2000 | Kodachi et al. |
| 6,149,156 | A | 11/2000 | Feola |
| 6,155,925 | A | 12/2000 | Giobbi et al. |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,168,523 | B1 | 1/2001 | Piechowiak et al. |
| 6,173,955 | B1 | 1/2001 | Perrie et al. |
| 6,174,234 | B1 | 1/2001 | Seibert, Jr. et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| D441,031 | S | 4/2001 | Seelig et al. |
| 6,213,876 | B1 | 4/2001 | Moore, Jr. |
| 6,220,593 | B1 | 4/2001 | Pierce et al. |
| 6,224,483 | B1 | 5/2001 | Mayeroff |
| 6,227,970 | B1 | 5/2001 | Shimizu et al. |
| 6,231,442 | B1 | 5/2001 | Mayeroff |
| 6,231,445 | B1 | 5/2001 | Acres |
| D443,313 | S | 6/2001 | Brettschneider |
| 6,251,013 | B1 | 6/2001 | Bennett |
| 6,254,481 | B1 | 7/2001 | Jaffe |
| 6,260,296 | B1 | 7/2001 | Carney, Jr. |
| 6,261,177 | B1 | 7/2001 | Bennett |
| 6,267,669 | B1 | 7/2001 | Luciano, Jr. et al. |
| 6,270,411 | B1 | 8/2001 | Gura et al. |
| 6,299,165 | B1 | 10/2001 | Nagano |
| 6,302,790 | B1 | 10/2001 | Brossard |
| 6,305,686 | B1 | 10/2001 | Perrie et al. |
| 6,309,300 | B1 | 10/2001 | Glavich |
| 6,312,334 | B1 | 11/2001 | Yoseloff |
| 6,315,660 | B1 | 11/2001 | DeMar et al. |
| 6,315,663 | B1 | 11/2001 | Sakamoto |
| 6,315,664 | B1 | 11/2001 | Baerlocher et al. |
| 6,319,124 | B1 | 11/2001 | Baerlocher et al. |
| 6,336,863 | B1 | 1/2002 | Baerlocher et al. |
| 6,340,158 | B2 | 1/2002 | Pierce et al. |
| 6,343,988 | B1 | 2/2002 | Walker et al. |
| 6,346,043 | B1 | 2/2002 | Colin et al. |
| 6,347,996 | B1 | 2/2002 | Gilmore et al. |
| 6,364,766 | B1 | 4/2002 | Anderson et al. |
| 6,364,767 | B1 | 4/2002 | Brossard et al. |
| 6,368,216 | B1 | 4/2002 | Hedrick et al. |
| 6,386,974 | B1 | 5/2002 | Adams |
| 6,398,220 | B1 | 6/2002 | Inoue |
| 6,419,579 | B1 | 7/2002 | Bennett et al. |
| 6,439,995 | B1 | 8/2002 | Hughs-Baird et al. |
| 6,457,714 | B1 | 10/2002 | Feola |
| 6,461,241 | B1 | 10/2002 | Webb et al. |
| 6,464,582 | B1 | 10/2002 | Baerlocher et al. |
| D465,531 | S | 11/2002 | Luciano, Jr. et al. |
| 6,481,713 | B2 | 11/2002 | Perrie et al. |
| 6,506,118 | B1 | 1/2003 | Baerlocher et al. |
| 6,514,141 | B1 | 2/2003 | Kaminkow et al. |
| 6,533,660 | B2 | 3/2003 | Seelig et al. |
| 6,537,152 | B2 | 3/2003 | Seelig et al. |
| 6,575,830 | B2 | 6/2003 | Baerlocher et al. |
| 6,582,307 | B2 | 6/2003 | Webb |
| 6,585,591 | B1 | 7/2003 | Baerlocher et al. |
| 6,599,185 | B1 | 7/2003 | Kaminkow et al. |
| 6,602,137 | B2 | 8/2003 | Kaminkow et al. |
| 6,609,972 | B2 | 8/2003 | Seelig et al. |
| 6,712,694 | B1 | 3/2004 | Nordman |
| 6,731,313 | B1 | 5/2004 | Kaminkow |
| 6,802,775 | B2 | 10/2004 | Baerlocher et al. |
| 7,241,220 | B2 * | 7/2007 | Rothkranz et al. ..... 463/20 |
| 7,258,609 | B2 * | 8/2007 | Nordman et al. ..... 463/20 |
| 2004/0048645 | A1 | 3/2004 | Webb et al. |
| 2004/0053687 | A1 | 3/2004 | Nordman et al. |
| 2004/0248640 | A1 | 12/2004 | Kaminkow et al. |
| 2005/0037835 | A1 | 2/2005 | Nordman |
| 2005/0051964 | A1 | 3/2005 | Nordman |
| 2005/0054422 | A1 | 3/2005 | Rothkranz et al. |
| 2005/0054424 | A1 * | 3/2005 | Rothkranz et al. ..... 463/20 |
| 2005/0054428 | A1 * | 3/2005 | Nordman et al. ..... 463/25 |
| 2005/0056996 | A1 | 3/2005 | Nordman |
| 2006/0084485 | A1 * | 4/2006 | Elias ..... 463/16 |

FOREIGN PATENT DOCUMENTS

| | | |
|---|---|---|
| GB | 762611 | 11/1956 |
| GB | 912682 | 12/1962 |

OTHER PUBLICATIONS

Cyberdyne Gaming advertisement written by Cyberdyne Gaming, available prior to Oct. 4, 2004.

Elvira® Mistress of the Dark™ advertisement written by IGT, published in 2002.

Elvis Hits Advertisement written by IGT, published in 1999.

Holy Smoke advertisement written by Impulse Gaming Ltd., available prior to Oct. 4, 2004.

Party Time Psycho Cash Beast advertisement written by IGT, published in 1999.

Pick a Prize advertisement written by Acres Gaming Incorporated, available prior to Oct. 4, 2004.

Royal Roulette advertisement written by Impulse Gaming Ltd., available prior to Oct. 4, 2004.

Spin-A-Lot advertisement written by Acres Gaming Incorporated, available prior to Oct. 4, 2004.

Take Your Pick Article written by Strictly Slots, published in Mar. 2001.

Wheel of Fortune advertisement written by IGT, published in 1998.

Wheel of Fortune advertisement written by IGT, published in 1999.

Wheel of Fortune Slots S2000 Series advertisement, published in 2002.

Wheel of Fortune Video Slots advertisement on the website http://www.igt.com/games/new_games/wheel.html, printed Mar. 21, 2001.

* cited by examiner

GAMING DEVICE WITH MULTIPLE ORBIT AWARD INDICATOR

BACKGROUND OF THE INVENTION

The present invention relates to a wagering gaming device having a multiple orbit display.

Gaming devices, such as slot machines and video poker machines, provide fun and excitement for the player. Gaming, in general, provides an escape from the everyday rigors of life. Gaming devices and gaming establishments use bright lights and exciting sounds to set the gaming world apart from the rest of the world. Gaming devices, in particular, use one or more displays that enable the player to see and play the game. The displays typically portray the action of the game and ultimately indicate whether or not the player wins and often how much the player wins.

Slot machine and other gaming device displays have gone through a number of transitions since their inception. Originally, slot machines displayed purely mechanical reels. While these machines gained enormous popularity, the mechanical nature of the reels limited the number of paystops, which limited the number of different symbols and the number of different winning symbol combinations.

The advent of the computer and the video monitor expanded the possibilities for gaming devices. There are now video poker, video blackjack and other types of video gaming machines. Video displays have also been implemented in slot machines. The video slot machines use computers to randomly generate symbol combinations from an expanded number of different symbols. Video reel strips can include a virtually unlimited number of symbols, which enables a wide variety of different symbol combinations to be employed, including combinations that appear very infrequently and yield high payouts.

With slot machines, the video monitors have also been used to provide bonus or secondary games. Bonus games in wagering gaming machines have become much more prevalent and elaborate in recent years. For example, players play the base game of slot until becoming eligible for a bonus game. The base game temporarily pauses, while the player plays the bonus game. When the player completes the bonus game, the gaming device returns the player to the base game.

It should therefore be appreciated that a single video monitor is often sufficient to provide both the base game of slot and one or more bonus games that become triggered by the slot game. As illustrated in FIGS. 1A and 1B, there is room on the cabinet of gaming device 10 for an upper display area 32. That area, however, is often not utilized for gaming purposes and may simply provide a paytable, graphics and/or lettering that pertains to a theme of the gaming device.

Video monitors and in particular video-based slot machines are likely going to continue growing in popularity. As the video monitor has been used more and more, however, there has been a growing sentiment that some of the mystique of the old time mechanical gaming devices is lost when mechanical reels and mechanical displays are replaced by a video monitor.

Accordingly, a need exists to provide a wagering gaming device that may use a video monitor, which provides increased flexibility to the gaming device to add more symbols and more elaborate bonus games, while providing some aspect of the gaming device that is mechanical and provides a fun and exciting mechanical display.

SUMMARY OF THE INVENTION

The present invention provides a display device for a gaming device and in one embodiment an electromechanical display device for a gaming device such as a slot machine or a video poker machine. The display device includes an indicator that simultaneously rotates about multiple different axes in an orbital fashion to indicate an award. The display device is provided in one embodiment as a secondary or bonus display, which appears or is mounted in the cabinet of the gaming device above a video monitor or mechanical display that runs a primary or base game associated with the bonus game. It should be appreciated however that the display device of the present invention is not limited to being a bonus display and can otherwise be incorporated into a base or primary game.

The display device includes a display area. The display area in one embodiment is the upper or top box portion of the cabinet of a gaming device, such as a slot machine. The display area includes or displays a plurality of symbols such as awards to the player. The awards may range in amount and variety as desired by the game implementer. The awards can be game credits, game credit multipliers, a number of picks from a prize pool, a number of free spins, a number of free games, bonus games, non-monetary awards and any combination thereof. The awards or award symbols are displayed in accordance with a theme of the display device and/or the gaming device. In the embodiments illustrated herein, the symbol award indicator, which simultaneously rotates about multiple different parallel axes in an orbital fashion, is a bee or bumblebee. The award symbols are displayed or illustrated as flowers on the display area. The present invention is not limited to any particular theme and the indicator and symbols or awards are not limited to any particular apparatus.

In one preferred embodiment, a plurality of motion-producing devices or motors are located behind the display area, out of the sight of the player. A first motion-producing device rotates a mounting flange to which a second motion-producing device is coupled. The output shaft of the second motion-producing device is coupled to the indicator via an extension arm. The first motion-producing device therefore rotates the second motion-producing device through a first radius, and the second motion-producing device rotates the indicator through a second radius. The indicator, which is observed by the player, is therefore seen to move in multiple rotational directions or multiple orbits, simultaneously or at different times.

In one preferred embodiment, the motion-producing devices are stepper motors. The stepper motors accept currents from motor drivers. The drivers accept high level commands from a motion controller or processor. The motion controller or processor runs a motion control program or profile that is installed by the game implementer to cause the indicator to move in a relatively complex, fun and exciting manner. Both motors are controlled to reverse directions multiple times, change and set angular velocities and change and set angular accelerations one or more times, etc. The motors rotate in the same or opposite directions and at the same or different times as desired.

When the indicator ultimately stops moving, the indicator indicates one of the award symbols, which is provided to the player. The indicator indicates an award symbol in one of a multitude of ways. In one embodiment, the indicator lands on or covers the provided award symbol. In such a case, the indicator includes a see-through or transparent area such as a glass or clear plastic window for the player to view the selected award symbol. One, or a plurality of the award symbols can be illuminated simultaneously or sequentially to provide further excitement and enjoyment. For example, an award symbol can be illuminated whenever the indicator moves over or covers the award symbol. The light is seen around the indicator and through the see through area or window housed within the indicator.

In an alternative embodiment, the indicator points to an award symbol provided to the player. In the illustrated embodiment, the indicator bee includes a stinger that ultimately points towards the awards selected for the player. Here, one or more award symbols are illuminated sequentially or simultaneously with one or more other symbols as desired. After the gaming device provides the selected award symbol to the player, the game ends or the player returns to the base game depending on the role of the display device within the gaming device. Other uses of the display are within the scope of the present invention.

It is therefore an advantage of the present invention to provide a fun and interesting gaming device display.

It is another advantage of the present invention to provide a fun and interesting apparatus and method of designating a symbol such as an award symbol for a player.

It is a further advantage of the present invention to provide a display device that includes an award indicator that simultaneously rotates in multiple orbits.

It is still another advantage of the present invention to provide a display device that is operable as a base game or as a bonus game in cooperation with a wide variety of base games.

Additional features and advantages of the present invention are described in, and will be apparent from, the following Detailed Description of the Invention and the figures.

DETAILED DESCRIPTION OF THE INVENTION

The present invention provides a display and display indicators that operate with a multitude of primary or base wagering games, including but not limited to the games of slot, poker, keno, blackjack, craps and bunco. In an embodiment, the display and indicators operate in conjunction with secondary or bonus games, which in turn operate in conjunction with the above listed primary games. Besides such base and bonus games, the present invention can operate with any of the bonus triggering events, as well as any progressive game coordinating with those base games. The symbols and indicia used for any of the primary or base games, bonus or secondary games or progressive games include any suitable symbols, images or indicia.

Figure 1A:
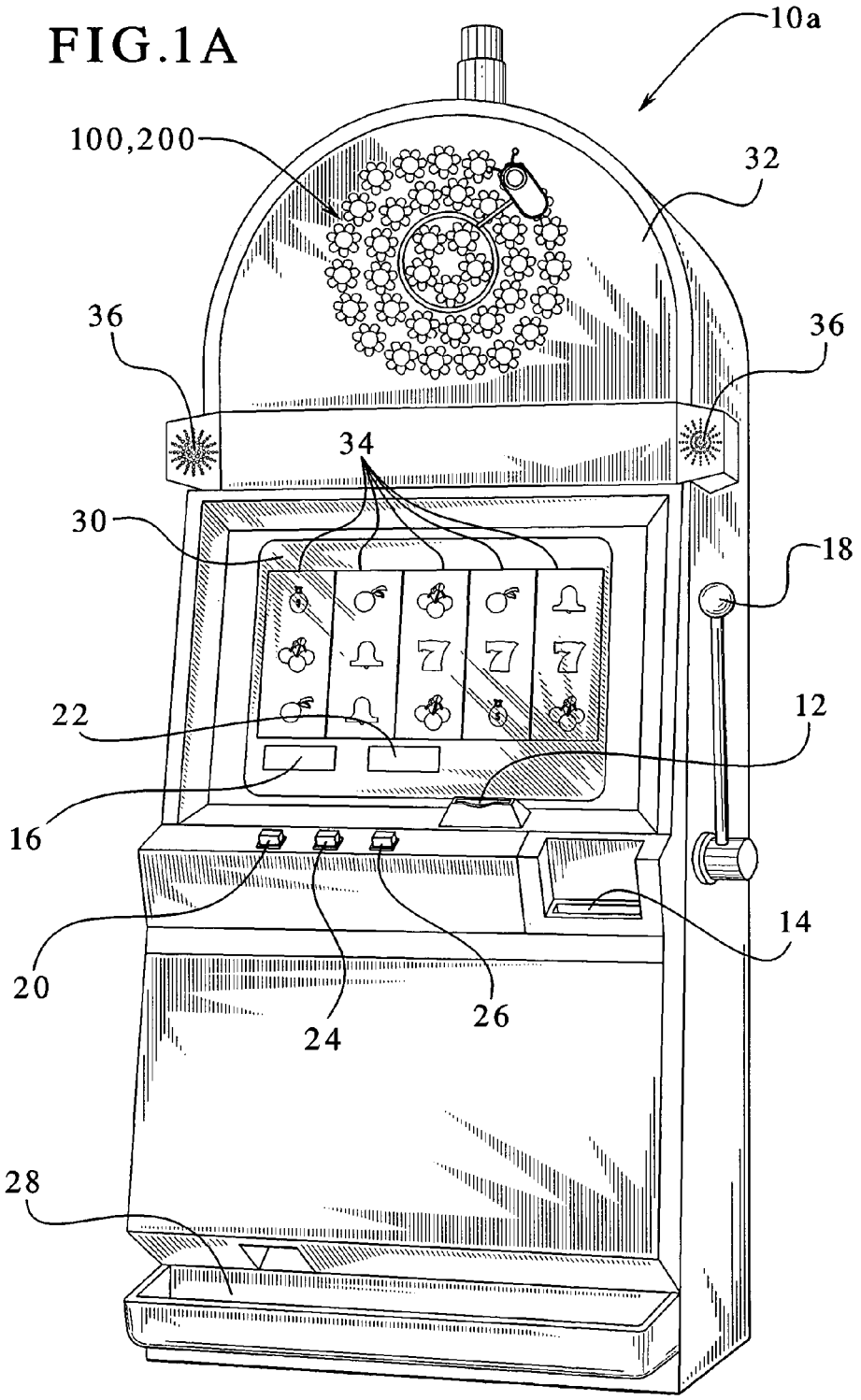
FIGS. 1A and 1B are perspective views of alternative embodiments of the gaming device of the present invention.
Figure 1B:
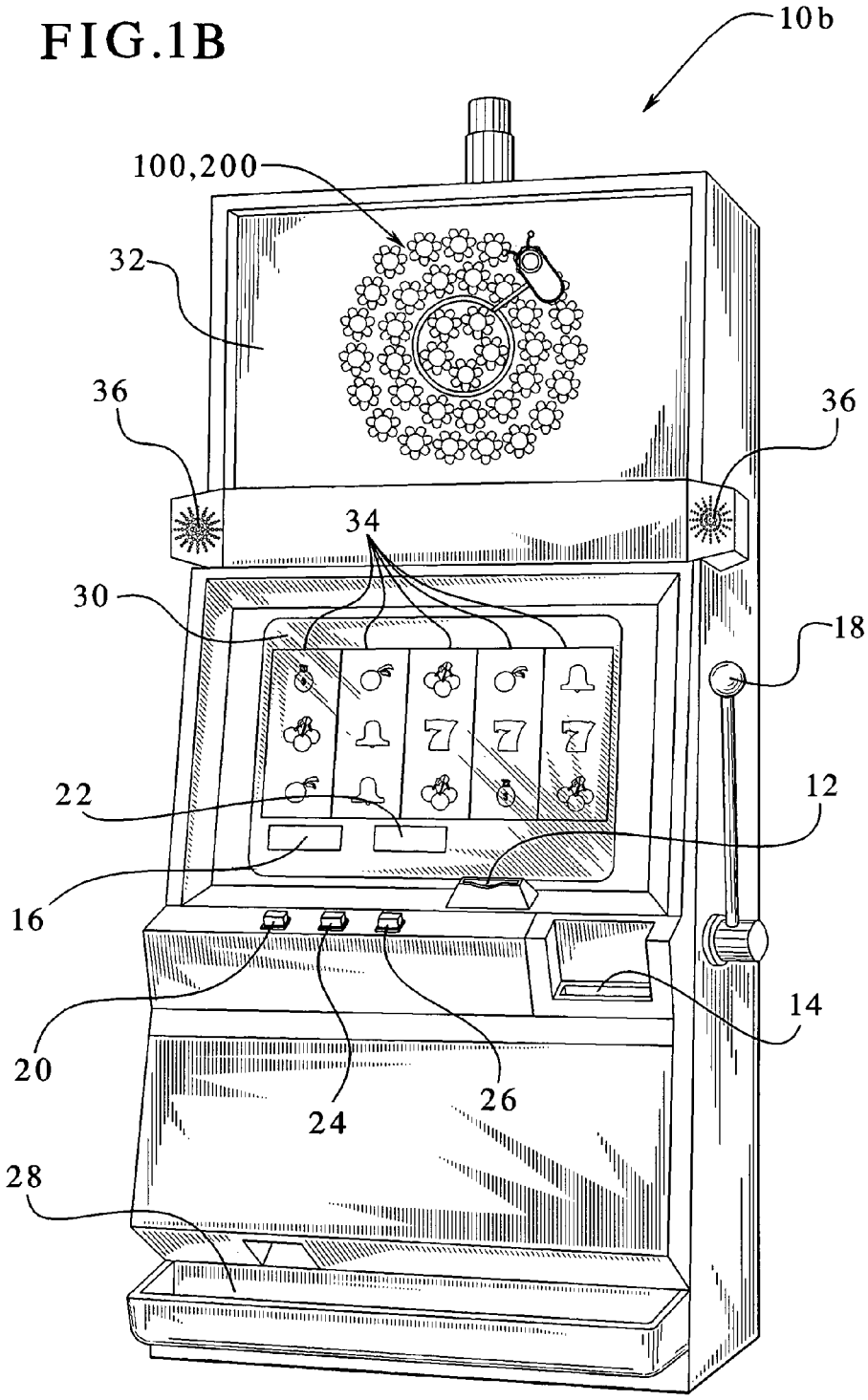

One primary embodiment for the multiple orbiting indicator of the present invention is with a slot game. Referring now to the drawings, and in particular to FIGS. 1A and 1B, one slot machine embodiment is illustrated. Gaming devices 10*a* and 10*b* illustrate two possible cabinet styles and display arrangements and are collectively referred to herein as gaming device 10. Gaming device 10 is illustrated as having the controls, displays and features of a conventional slot machine, wherein the player operates the gaming device while standing or sitting. Gaming device 10 can also be a pub-style or table-top game (not shown) for which a player operates while sitting.

Gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player increases the bet by one credit each time the player pushes the bet one button 24. When the player pushes the bet one button 24, the number of credits shown in the credit display 16 decreases by one, and the number of credits shown in the bet display 22 increases by one. A player cashes out by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiments shown in FIGS. 1A and 1B include a display device 30 and a cabinet having an upper display area 32. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The multiple orbiting indicator and award symbols of the present invention are provided, in an embodiment, in the upper display area 32 of the cabinets of gaming devices 10*a* and 10*b* of FIGS. 1A and 1B. The indicator and award symbols of the present invention are provided, in another embodiment, on top of the rounded cabinet of gaming device 10*a* or rectangular cabinet of gaming device 10*b*. In a further embodiment, the top portion or top box of the gaming device is removed, creating a lower profile machine. Here, the multiple orbiting indicator and award symbols of the present invention are provided on top of gaming device but are lower to the ground than if the top box is not removed.

The slot machine embodiment of gaming device 10 includes a plurality of reels 34, for example three to five reels 34. Each reel 34 includes a plurality of indicia such as bells, hearts, fruits, numbers, letters, bars or other images which correspond to a theme associated with the gaming device 10. If the reels 34 are in video form, the display device displaying the video reels 34 is, in one embodiment, a video monitor. Gaming device 10 includes speakers 36 for making sounds or playing music.

With reference to the slot machine base game of FIGS. 1A and 1B, to operate gaming device 10, the player inserts the appropriate amount of tokens or money in the coin slot 12 or the payment acceptor 14 and then pulls arm 18 or pushes play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, gaming device 10, including any of the base games disclosed above, also includes bonus games that give players the opportunity to win credits. Gaming device 10 in one embodiment employs a video-based display device 30 in combination with the multiple orbiting display of the present invention to provide either a base or bonus wagering game. The bonus games include a program that automatically begins when the player achieves a qualifying condition in the base game.

Figure 2:
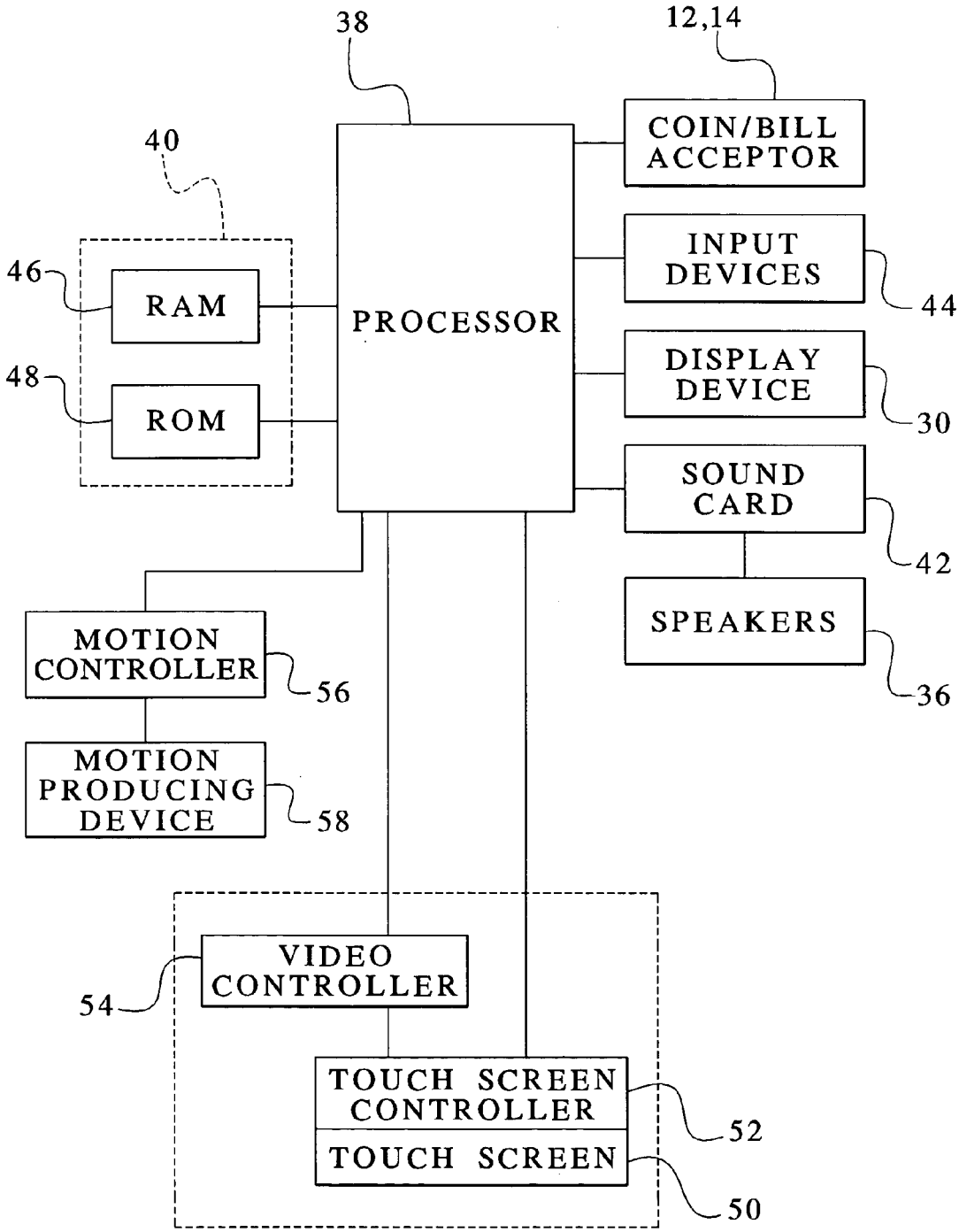
FIG. 2 is a schematic block diagram of the electronic configuration of one embodiment of the gaming device of the present invention.

Referring now to FIG. 2, one embodiment of an electronic configuration for gaming device 10 includes: a processor 38, a memory device 40 for storing program code or other data, a display device 30, a sound card 42, a plurality of speakers 36, and one or more input devices 44. The processor 38 is a microprocessor based platform that is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player uses the input devices 44 to input signals into gaming device 10. In the slot machine base game, the input devices 44 include pull arm 18, play button 20, the bet one button 24, the cash out button 26 and other player inputs. A touch screen 50 and touch screen controller 52 are connected to a video controller 54 and processor 38. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money to start the game.

Processor 38 also controls the output of one of more motion controllers 56 that control one or more motion producing devices 58. The motion producing devices 58 can be any combination of motors, servo motors, AC/DC motors or any other type of device that outputs a rotating member. The motion controllers 56 typically include printed circuit boards or stand alone enclosures that receive high level commands from the processor 38. The motion controller 56 converts the high level commands, for example, into a number of step pulses, which in turn are converted into motor currents. The stepper motor or other type of motion producing device 58 receives the currents, wherein the currents cause, for example, a rotor to turn within a stator a precise and desired amount.

The controllers 56 and motion devices 58 produce motion control scheme that includes complex movements of multiple parts. That scheme is programmed into the memory device 40 and carried out by the processor 38 at the appropriate time in the sequence of the game, be it a base, bonus, bonus triggering or progressive sequence of gaming device 10. Moreover, multiple programs can be implemented in the memory device 40, wherein the processor runs the appropriate program at the appropriate time, and wherein the multiple orbiting indicator described below can perform or move differently, e.g., faster, slower or in different rotational directions at different times or points in the game. The motion control programs, in one embodiment, interface with one or more random generation devices, typically software based items, to produce randomly displayed outcomes on the displays of the present invention.

Figure 3:
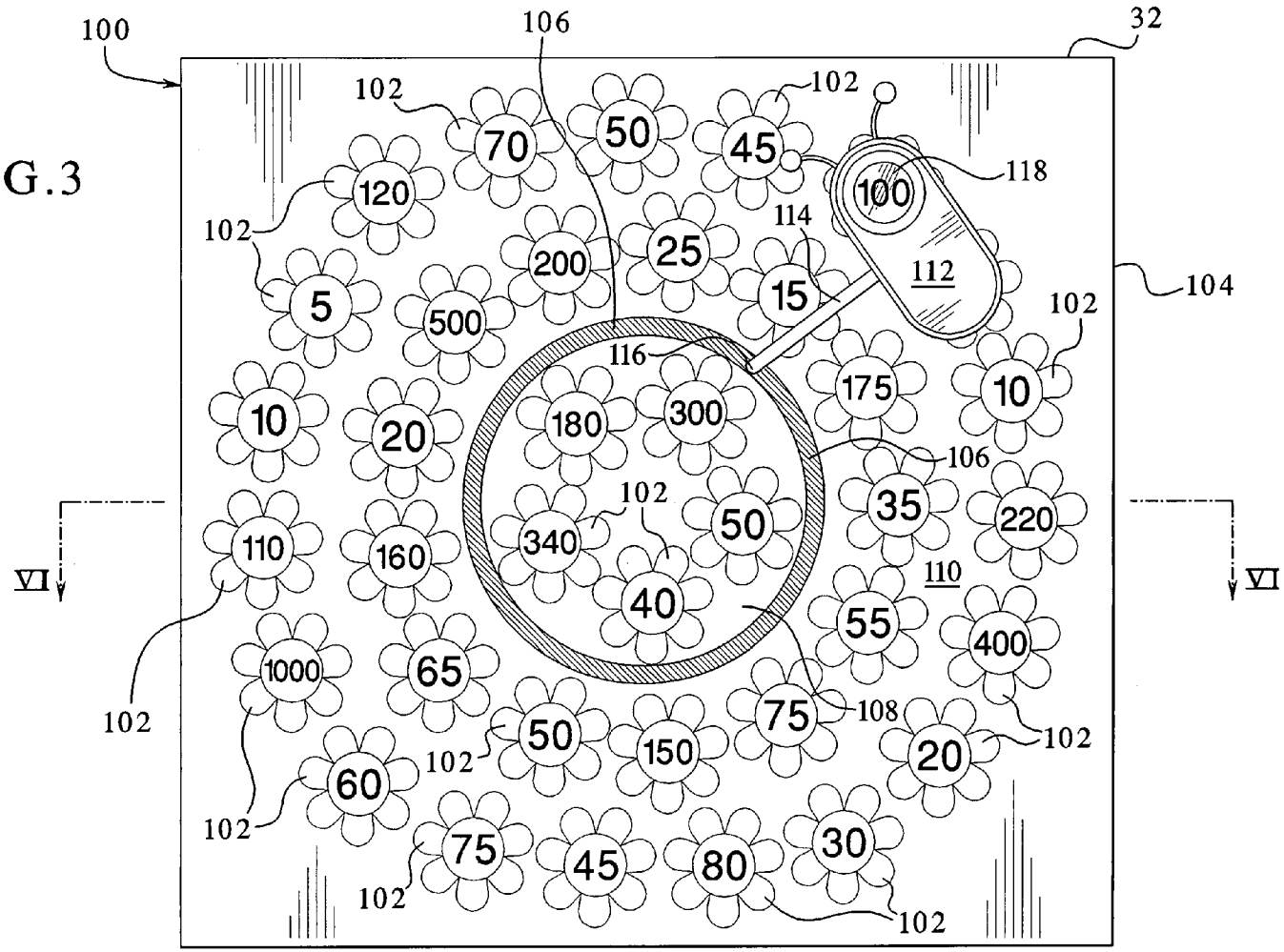
FIG. 3 is an elevation view of a display area of the gaming device having one embodiment of a multiple award indicator of the present invention.

Referring now to FIG. 3, display 100 illustrates one possible embodiment of the present invention. Display 100 is located in the upper display area 32 shown in FIGS. 1A and 1B. Display 100 includes a plurality of symbols such as award symbols 102. Award symbols 102 in an embodiment are two-dimensional images illustrated on standard gaming device glass or plastic. In the illustrated embodiment, award symbols 102 follow a theme of the gaming device, namely a bee buzzing around a plurality of flowers. In an alternative embodiment, a portion or all of the award symbols includes a three-dimensional structure that is secured to the upper display area 32.

The award symbols 102 in an embodiment are selectively or collectively illuminated to highlight various features of the display 100 of the present invention. That is, one or more lights is provided behind one, a plurality of or all of the award symbols 102. The lights are located behind a panel 104 or upper display area 32 in one embodiment. Panel 104 of upper display area 32 of display 100 also defines a slot 106. In particular, an inner circular portion 108 and an outer portion 110 of panel 104 define slot 106. The panel 104 is preferably metal, plastic or a combination thereof. Although not illustrated, slot 106 is preferably covered by a moveable flap as well as the award symbols 102.

In the illustrated embodiment, slot 106 is continuous and allows an indicator 112 to rotate a full three hundred sixty degrees about an axis that is located substantially perpendicular to panel 104 at the center of the inner portion 108 of panel 104. As discussed in more detail below, indicator 112 is connected via an arm 114 to a motor that rotates arm 114 and indicator 112 about an axis substantially perpendicular to panel 104 at pivot point 116. The motor that turns arm 114 and indicator 112 is in turn rotated by a first or primary motor as illustrated in FIGS. 5 and 6. Using the two motors, a fun, exciting and interesting orbital motion is created for indicator 112, which simultaneously travels in two orbits in display 100.

Arm 114 is sized in conjunction with the radius of slot 106 so that indicator 112 can reach each of the displayed award symbols 102. A larger radius and shorter length for the arm 114 tends to allow indicator 112 to reach more awards 102. The size of the radius and the arm 114 effects the appearance of the multiple orbiting motion.

The motors cooperate to rotate the indicator 112 in multiple directions, at multiple speeds and at multiple accelerations and decelerations. The motors rotates the indicator 112 together or individually. Indicator 112 appears to fly about the upper display area 32, moving over and indicating various award symbols 102 along the way. Eventually, the multiple orbiting stops and indicator 112 selects or indicates a symbol such as an award that is provided to the player. FIG. 3 illustrates that indicator 112 has stopped on, indicates and thus selects the award one hundred for the player. In the illustrated embodiment, indicator 112 covers or sits over the selected award symbol 102. The indicator 112 houses a glass or clear plastic sight glass 118 that allows the player to see the award symbol 102 selected for the player.

The award provided to the player is randomly chosen in a preferred embodiment. The award, while randomly chosen, is preferably selected at some point prior to the indicator 112 stopping and indicating the award. That is, after processor 38 of gaming device 10 randomly generates an award for the player, the processor 38 commands the motion controllers 56 and the motion producing devices 58 carry out a motion control program, sequence or profile that provides a fun and exciting mechanical display, and in which indicator 112 ultimately stops and indicates the randomly selected award.

It should be appreciated that the present invention can alternatively place sensors in cooperation with award symbols 102 to detect the presence of indicator 112 and thereby send a signal to the processor 38 to tell the processor which award the indicator 112 ultimately indicates for the player. That configuration however requires more apparatus, more electronics and a more complicated program to accomplish the same goal, namely, to provide a randomly generated award to the player as is accomplished if the multiple sensor embodiment is used.

Figure 4:
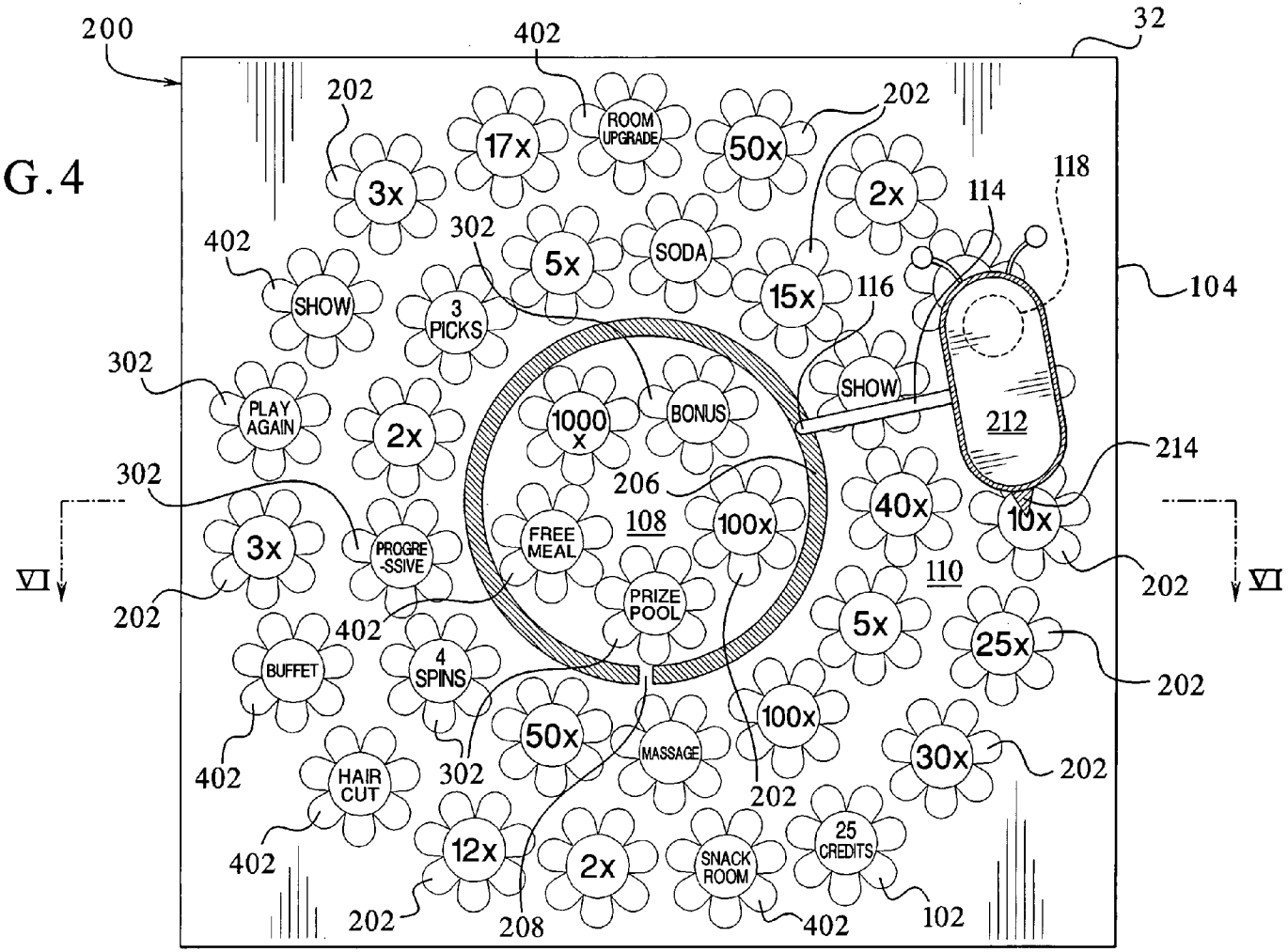
FIG. 4 is an elevation view of a display area of the gaming device having another embodiment of the multiple orbiting award indicator of the present invention.

FIG. 3 illustrates that award symbols 102 each provide a credit value. Gaming device 10 updates the total on the player's credit display 16 by the amount of credits provided by a selected one of the award symbols 102. FIG. 4 illustrates an alternative display 200, which also includes a panel 104 in upper display area 32. Display 200 provides alternative types of award symbols, such as multipliers 202. Multipliers 202 multiply any type of accumulation of gaming device credits, such as a player's total wager, a player's total credits, a player's wager per payline or a number of paylines wagered (slot), as well as other base or bonus game credit values.

Display 200 also illustrates other types of awards 302 that gaming device 10 can provide, such as free games, replays, a number of free spins, picks from a prize pool, a progressive pool update and any combination thereof. Further, display 200 includes non-monetary or non-gaming device awards 402, such as tickets to a show, a free meal or free buffet, a free drink or a room upgrade. Display 200 also includes a credit value symbol 102 of twenty-five credits. Gaming device 10 can therefore provide one or a plurality of different types of awards in operation with the displays of the present invention. As discussed above, any one, or more or all of the award symbols are individually or collectively lighted in one embodiment.

Panel 104 of alternative display 200 defines an alternative slot 206. Slot 206 is not continuous and instead includes a tab 208 that connects inner panel portion 108 to outer panel portion 110. Tab 208 prevents the indicator 212 and arm 114 from rotating a complete 360 degrees about an axis located substantially at the center of alternative slot 206. The arm 114 and indicator 212 are however able to rotate virtually all the way around the axis, wherein the rotation changes directions when approaching tab 208. The indicator 212 and arm 114 are able to rotate a complete 360 degrees about pivot 116 in both FIGS. 3 and 4.

Alternative indicator 212 employs a different apparatus and method for indicating or selecting an award in display 200. Indicator 212 includes a pointer 214, which in accordance with the theme of the present invention is the stinger of the bumble bee. Instead of landing directly on or over the selected award, indicator 212 stops moving directly adjacent to the selected award, wherein pointer 214 clearly indicates to the player that the selected award is, for example, the award symbol 202 of "10×". Sight glass 118 is illustrated in phantom for the purposes of showing that the indicators of the present invention can employ both apparatuses for showing the player the awards selected, wherein gaming device 10 can switch methods of indication as desired.

Figure 5A:
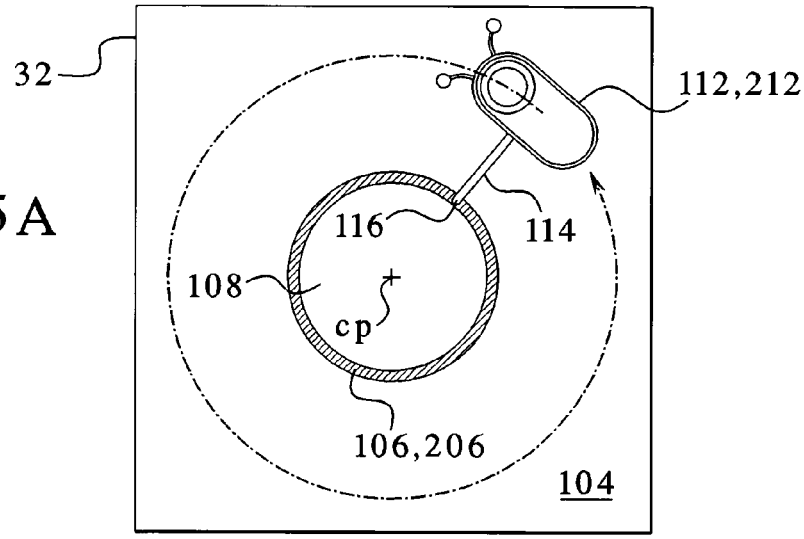
FIGS. 5A, 5B and 5C illustrate schematically the multiple orbiting motion of the indicator of the present invention.
Figure 5B:
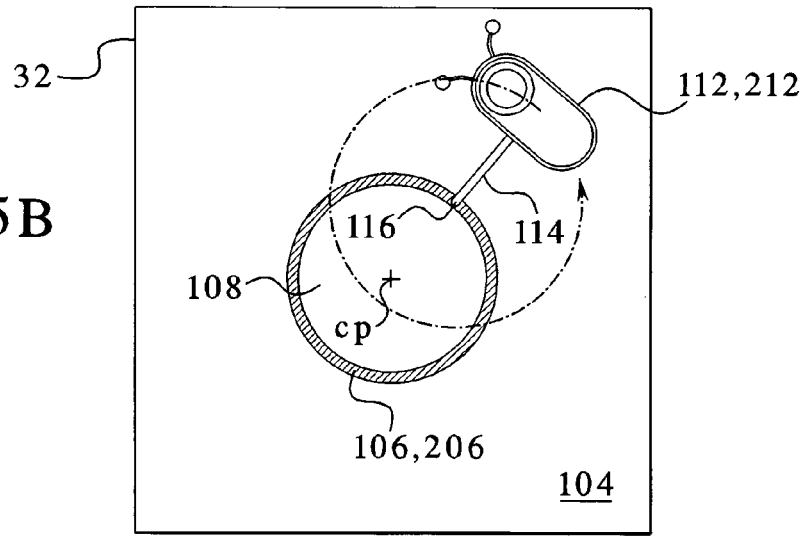
Figure 5C:
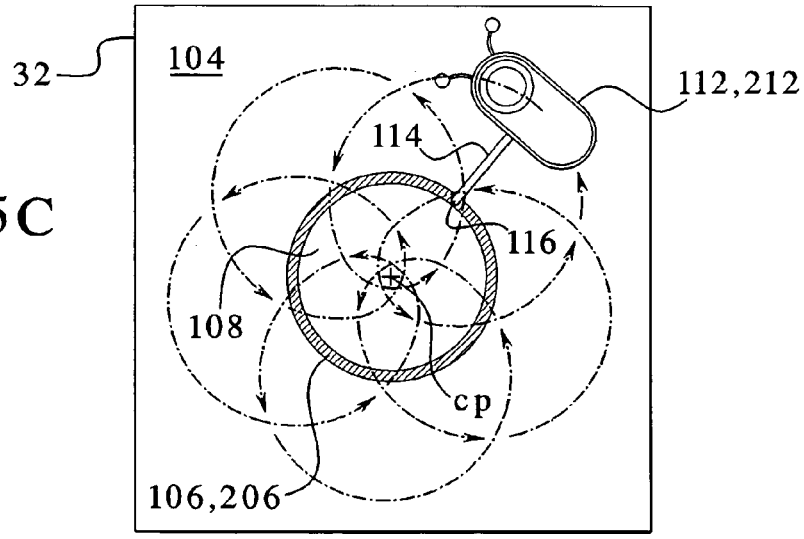
Figure 6:
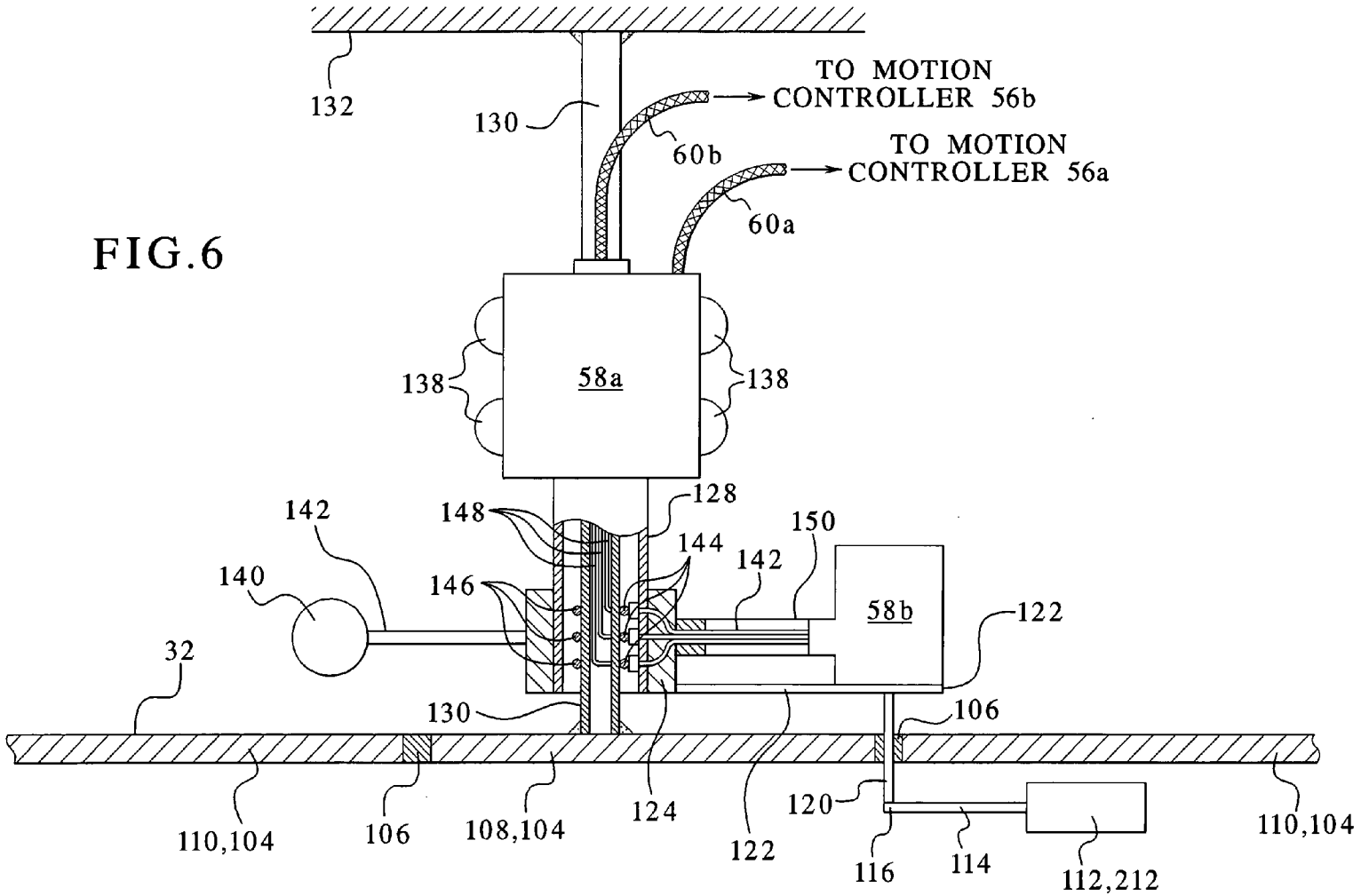
FIG. 6 is a sectional view taken substantially along line VI-VI of FIGS. 3 and 4 illustrating one embodiment for arranging the multiple motors of the present invention.

Referring now to FIGS. 5A to 5C, the motion of indicator 112/212 is shown schematically. The phantom circles and arrows strike the paths made by indicator 112/212. The paths shown in FIG. 5C are a superposition of the paths shown in FIGS. 5A and 5B. While the arrows in FIGS. 5A to 5C indicate a counterclockwise motion for both orbits of the indicator 112/212, one or both orbits is simultaneously or sequentially clockwise.

FIG. 5A illustrates a first or major orbit of the indicator 112/212 about a center point cp of inner portion 108 defined by slot 106. The path or major orbit illustrated by the phantom line of FIG. 5A is created when indicator 112/212 is rotated about center point cp, but wherein indicator 112/212 is not rotated by arm 114 about pivot 116.

FIG. 5B illustrates a second or minor orbit of the indicator 112/212 about pivot 116. The second or minor orbit is defined by the length of arm 114. As illustrated, the second or minor orbit does not involve the rotation of indicator 112/212 about center point cp but is effected by the position of pivot 116 about center point cp.

FIG. 5C shows paths defined by the phantom lines, wherein the paths are multiple second or minor orbits that occur at different times as indicator 112/212 rotates about center point cp of inner portion 108 defined by slot 106, i.e., in the major orbit. As stated above, either the major orbit of FIG. 5A, the minor orbit of FIG. 5B, or both, can occur in the clockwise or counter clockwise direction.

Figure 7:
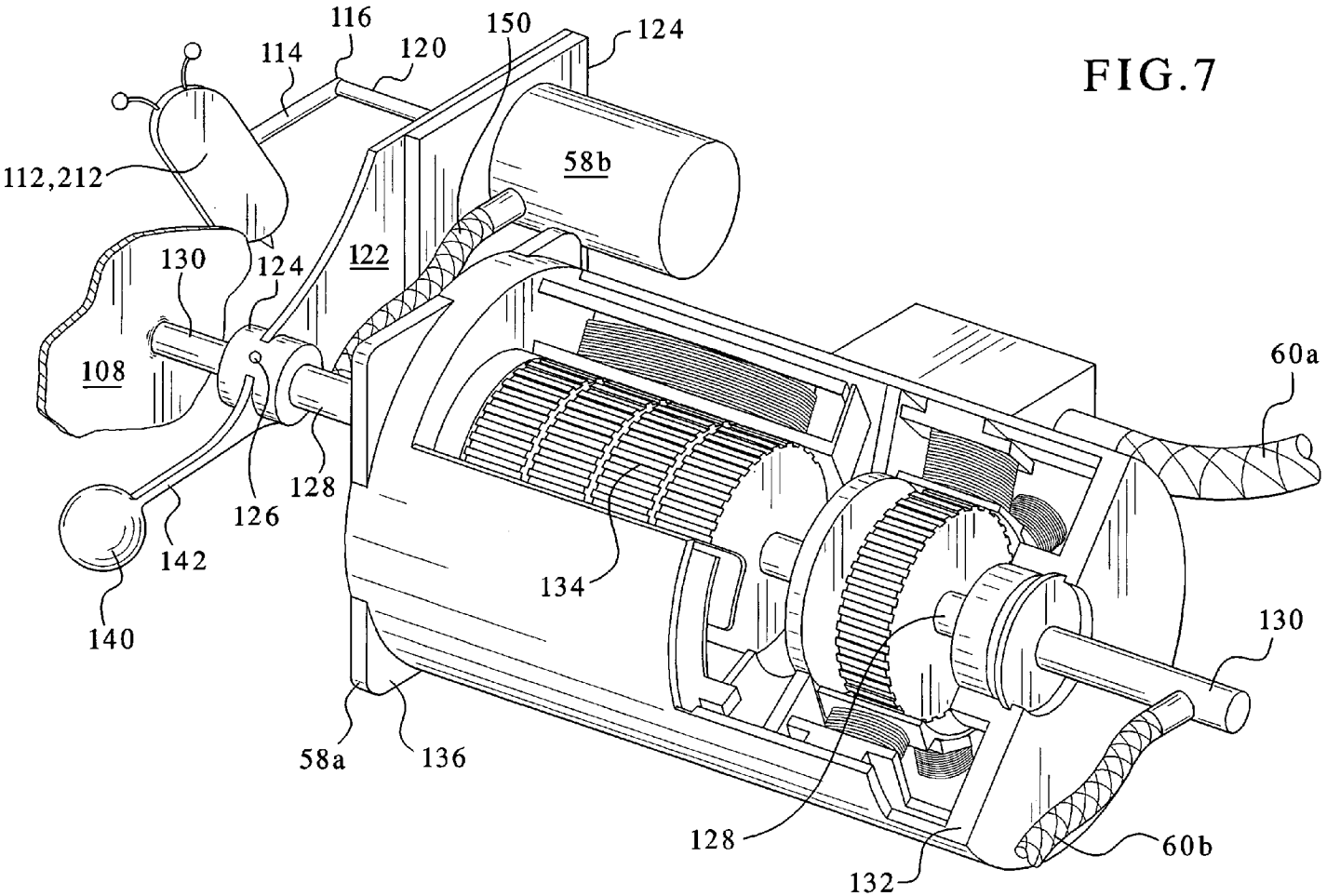
FIG. 7 is a perspective view of the motor configuration of FIG. 6 showing a portion of one of the motors cut away.

Referring now to FIGS. 6 and 7, one embodiment for producing the dual orbiting motion of indicator 112 about the panel 104 of display 100 of FIGS. 3 and 4 is illustrated. FIG. 6 illustrates first and second motion-producing devices 58*a* and 58*b* which rotate the indicator about two different spaced apart axes of rotation which are preferably substantially parallel (collectively motion-producing devices 58). For ease of description, motion-producing devices 58 are referred to in various places as stepper motors 58*a* and 58*b*. It should be appreciated however that other types of motors, such as servo motors and AC or DC brushed or brushless motors may be used. Stepper motors 58*a* and 58*b* are connected via cables 60*a* and 60*b* to respective motion controllers 56*a* and 56*b* (collectively motion controllers 56).

As illustrated in FIG. 2, processor 38 sends high level commands to one or more motion controllers 56 to command stepper motors 58 to perform a desired motion control sequence or profile. The high level commands sent to the motion controllers 56 are converted into step pulses that drive stepper motors 58*a* and 58*b*. Panel 104 is shown in cross-section so that slot 106, inner portion 108 or panel 104 and outer portion 110 of panel 104 are illustrated. In FIG. 5, indicator 112 is connected via arm 114 to a motor shaft extension 120 that is driven by stepper motor 58*b*. Extension 120 couples to the output shaft of motor 58*b* via a coupler as is well-known in the art.

Stepper motor 58*b* has a front face mounting arrangement that mounts to flange 122. The motor shaft for motor 58*b* extends through flange 122 and couples to extension 120. Flange 122 couples to a coupling 124 that mounts, for example, via a set screw 126 to output shaft 128 of motor 58*a*. As illustrated in FIGS. 6 and 7, output shaft 128 of motor 58*a* is in effect a tube that is hollow and surrounds a fixed conduit 130. Fixed conduit 130 couples to or is fixed to inner portion 108 of panel 104 and is also fixed to a structural member 132 of gaming device 10 as illustrated in FIG. 6. Also shown in FIG. 6, a portion of output shaft 128 is cut away to illustrate fixed conduit 130 extending therethrough.

FIG. 7 shows a portion of a housing 132 of stepper motor 58*a* cut away to illustrate that a rotor 134 within housing 132 of stepper motor 58*a* is centered around the shaft 122 that is hollowed out so that fixed conduit 130 can extend through the shaft 128. In an embodiment, tubular output shaft 128 is created by drilling through a solid shaft provided by the manufacturer of stepper motor 58*a*. Conduit 130 is also tubular, which resists bending better than a like sized solid rod, and enables cabling for 58*b* to be run to flexible cable 60*b*.

Fixed conduit 130 can be relatively thin because inner portion 108 of panel 104 is a relatively small and light, e.g., light, metal or plastic, apparatus (shown in fragmentary format in FIG. 7). Inner portion 108 does not therefore place a large cantilever load on fixed conduit 130. Also, one or more linear slide bearings, for example, a lubricated plastic bearing, can be placed around fixed conduit 130 and within tubular output shaft 128.

Stepper motor 58*a* is supported via a front mounting flange 136 as shown in FIG. 7 or via a bottom mount 138 illustrated in FIG. 6, wherein flange 136 or mount 138 mounts to a structural member (not illustrated) of the cabinet (not illustrated) of the gaming device. In that manner, the stepper motor 58*a* is securely mounted to gaming device and enables fixed conduit 130 to effectively float within tubular output shaft 128 and support the inner portion 108 of front panel 104.

A counter weight 140 is secured to coupling 124 via extension 142 to offset the moment of inertia created by the weight of stepper motor 58*b*, flange 122, extension 120, arm 114 and indicator 112. Counter weight 140 and extension 142 are sized and weighted to counter properly the moment of inertia created by the above-listed components. The effect of the counter weight reduces uneven wear on the bearings of motor 58*a*. Indicator 112 will also create a moment of inertia about extension 120.

However, for purposes of maintaining a clean looking display a counter weight is not provided for indicator 112 in one embodiment. Further, indicator 112 is relatively light and therefore does not cause an extensive amount of uneven wear on the bearings of motor 58*b*. In an alternative embodiment, a second indicator 112 or 212 can be provided on a second arm 114 that extends in the opposite direction from arm 114 illustrated in FIGS. 6 and 7. That is, the present invention contemplates providing one, two or more preferably balanced indicators 212. In such a case, gaming device 10 indicates multiple awards and either selects from same or combines those indicated awards to provide an ultimate award to the player.

FIGS. 6 and 7 illustrate one embodiment for supplying power to the windings of the minor orbit motor 58*b*. Power wires 142 run from the windings of motor 58*b*, through coupling 124, to spring contacts 144 located on the inner wall of shaft 128. Spring contacts 144 are biased to make electrical contact with contact rings 146. Contact rings 146 are fixed about conduit 130. Contact rings 146 are in turn connected electrically with wires 148. Wires 148 run along the inside of fixed conduit 130 and exit conduit 130 at a place that is out of the way of the moving indicator 112, 212. Wires 148 exit conduit 130 through flexible cable 60*b*. A separate flexible cable 150 is also provided to protect wires 142 running from minor orbit motor 58*b* to spring contacts 144.

In another embodiment, inner portion 108 of panel 104 is coupled to the output shaft 128 of the motion producing device 58*a* and therefore rotates with the output shaft 128. Here, the apparatus is simplified because the portion 108 is allowed to rotate, negating the need for the modifications to device 58*a* described above. The trade off is manifested in the visual effect produced by this alternative embodiment. The award symbols 102 to 402 coupled to or displayed by the inner portion 108 will also rotate, which may detract somewhat from the multiple orbiting motion of indicators 112 and 212.

Figure 8:
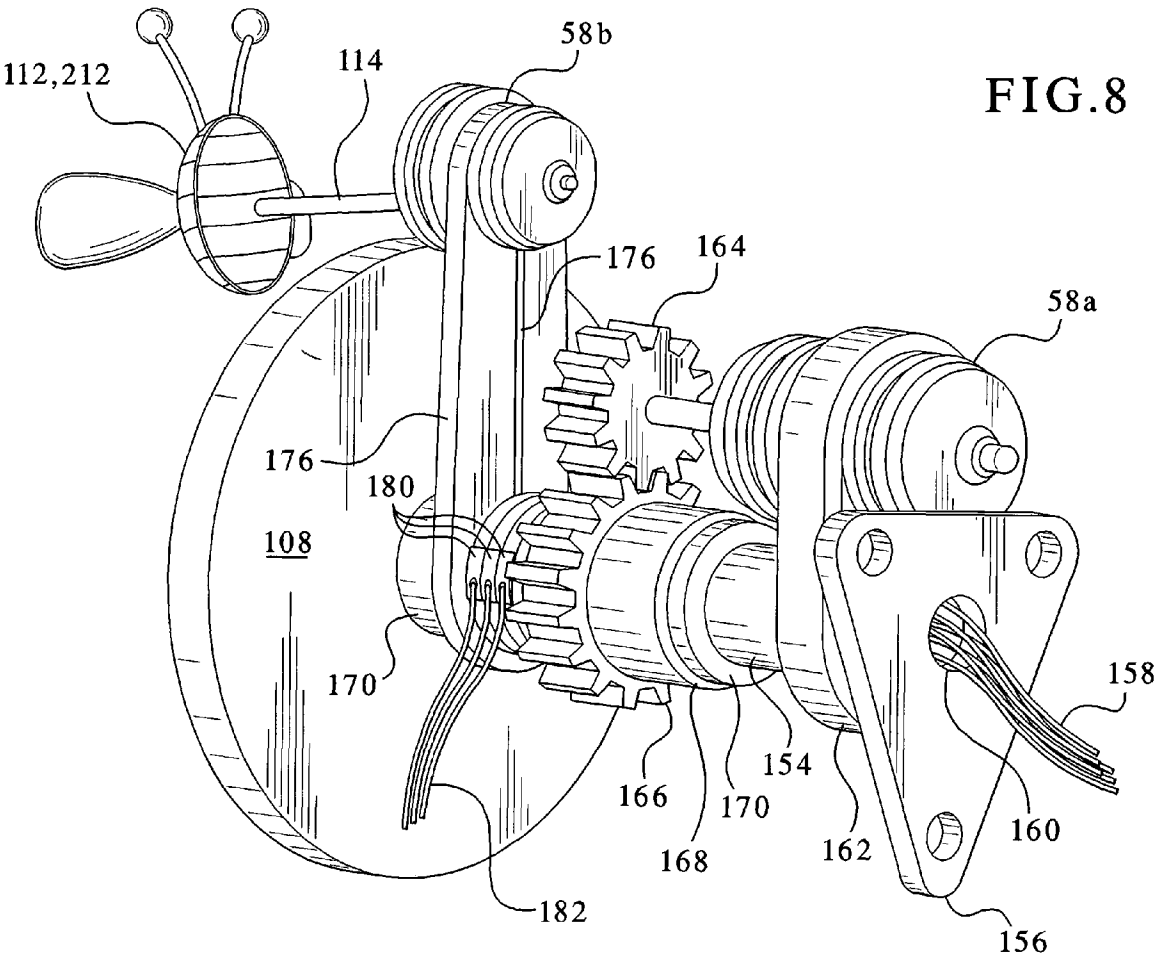
FIG. 8 is a perspective view of one alternative motor configuration for producing the multiple orbiting motion of the present invention.
Figure 9:
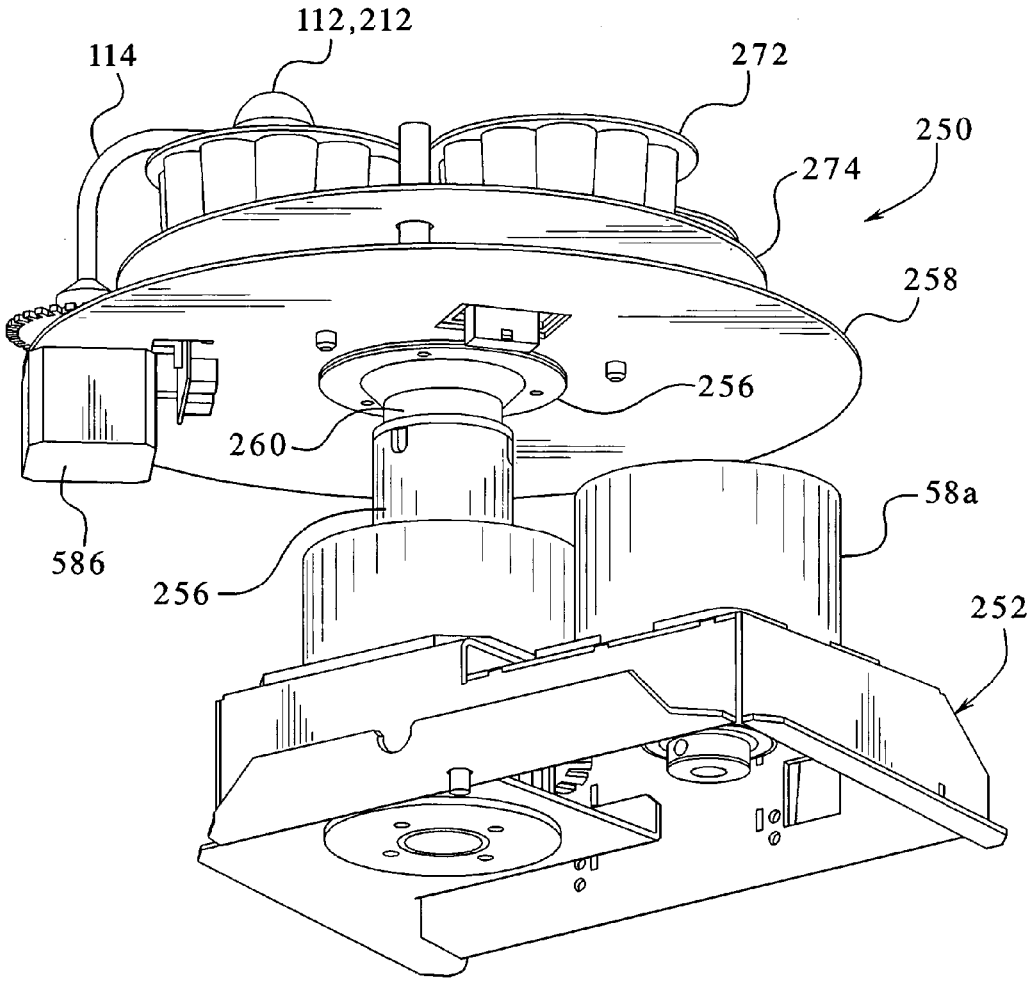
FIGS. 9, 10, 11 and 12 are perspective views of one alternative assembly for producing the multiple orbiting motion of the indicator of the present invention.
Figure 10:
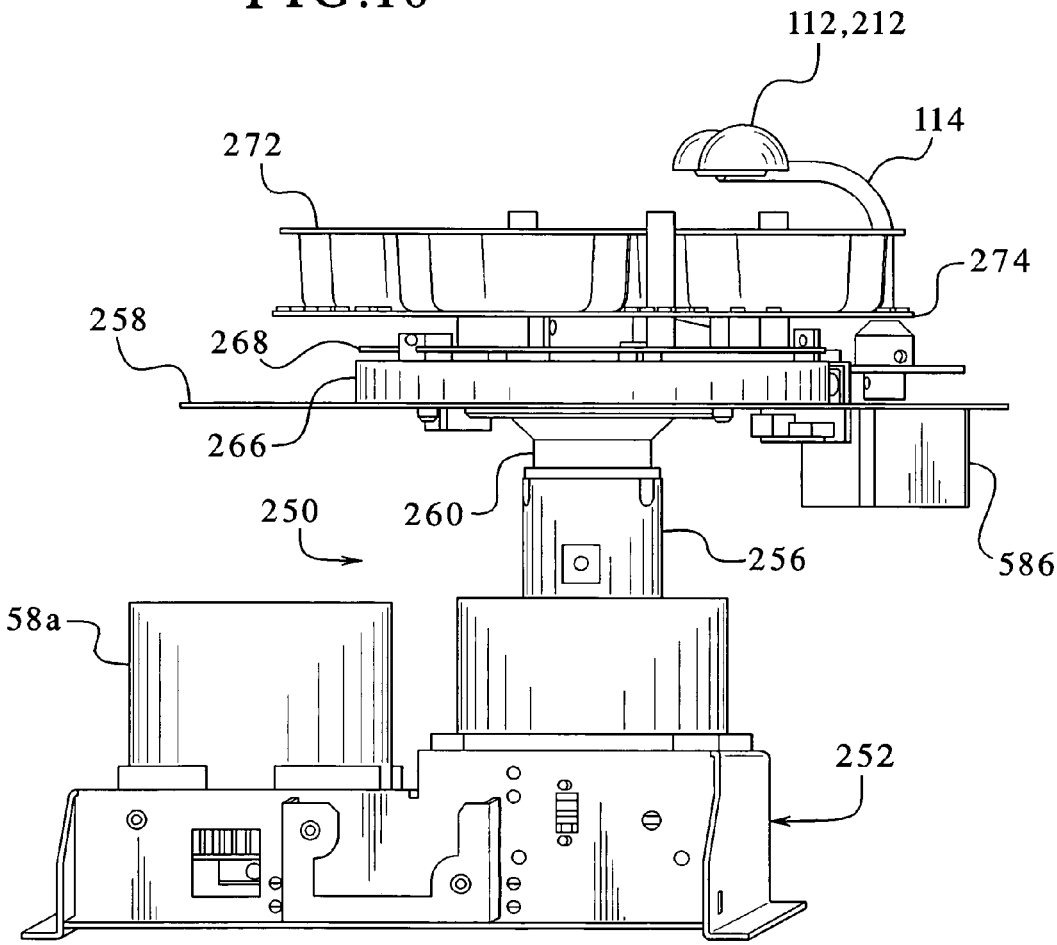
Figure 11:
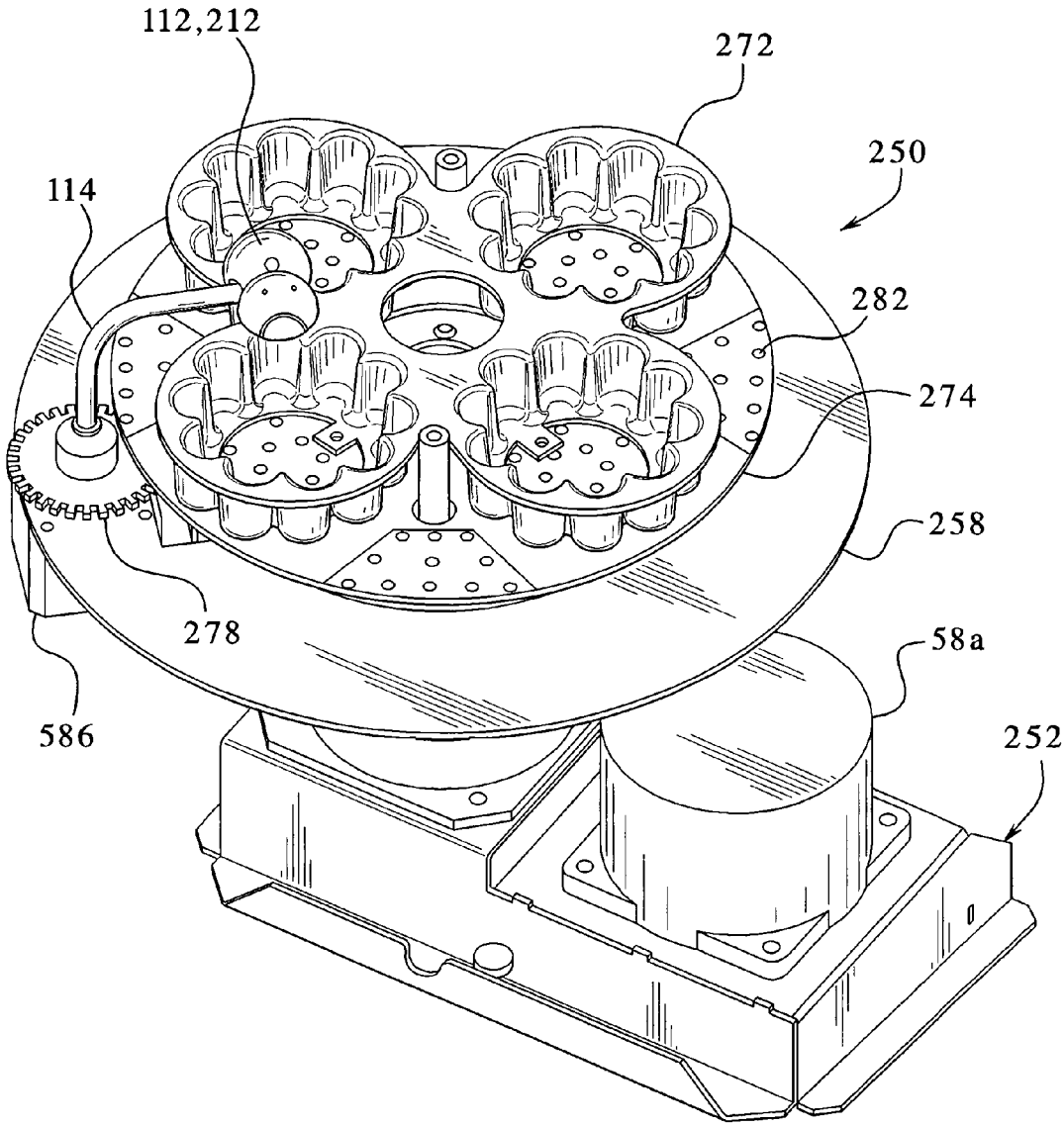
Figure 12:
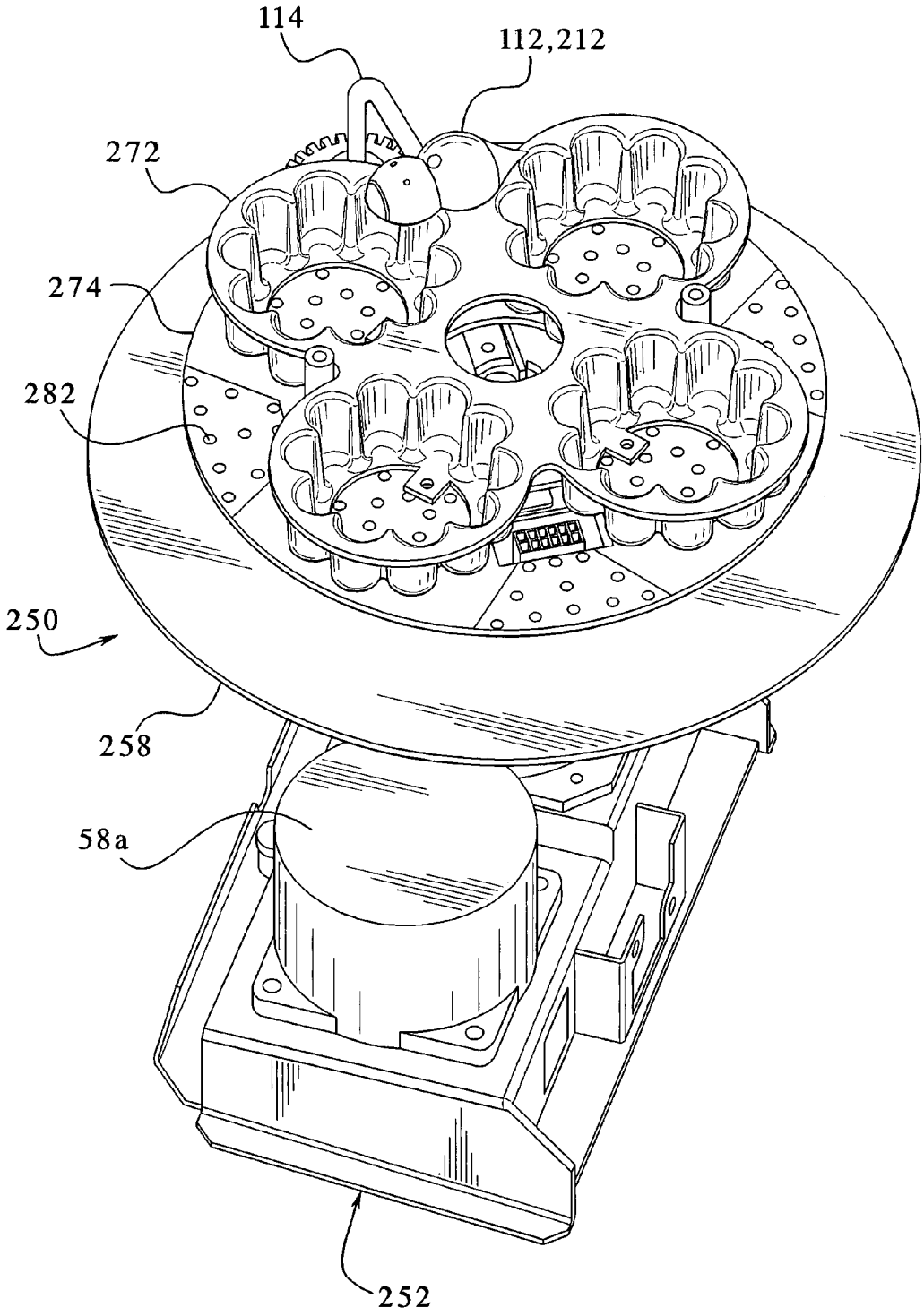

Referring now to FIG. 8, an alternative embodiment for configuring the motors 58*a* and 58*b* to produce the multiple orbiting indicating motion of the present invention is illustrated. Motion producing devices 58*a* and 58*b* can be of any variety discussed above. Motion producing device 58*a*, as above, creates the major orbit motion for indicator 112, 212, while device 58*b* causes the minor orbit motion. The configuration allows the major orbit to be a full three hundred sixty degrees, eliminating the need for the tab 208 of FIG. 4. Inner portion 108 is instead connected to the chassis (not illustrated) of gaming 10 via a fixed shaft 154, which is coupled to a mounting flange 156. Flange 156 fastens to the chassis or frame (not illustrated) of gaming device 10. Wires 158 of motor 56*a* extend through a hole 160 defined by flange 156. Wires 158 run through a flexible conduit (such as conduit 60*a*) to motor controller 58*a*. Arm 162 couples motor 58*a* to flange 156.

Motor 58*a* is coupled via gears 164 and 166 to output shaft 168. Shaft 168 rotates about fixed shaft 154 via bearing 170. Gears 164 and 166 have radii sized respectively to increase the amount of torque that motor 58*a* inputs to shaft 168 and arm 176 and motor 58*b* coupled therefore. The increased torque may eliminate the need for a counterweight as is used in FIGS. 6 and 7. The general connection does not place any momentary load on the shaft or motor 58*a* or the bearings supporting the shaft.

Wires 178 run from minor orbit motor 58*b* and connect electrically via spring contact brushes 180 and a rotating electrical contact to wires 182 as described above. Spring contact brushes 180 allow arm 176, motor 58*b* and indicator 112, 212 to rotate freely about fixed shaft 154, in eight angular directions and for any suitable number of rotations, without binding any electrical wires or cables. Wires 182 are fitted inside a suitable flexible conduit (such as conduit 60) and run to motor controller 58*b* as described above.

Figure 13:
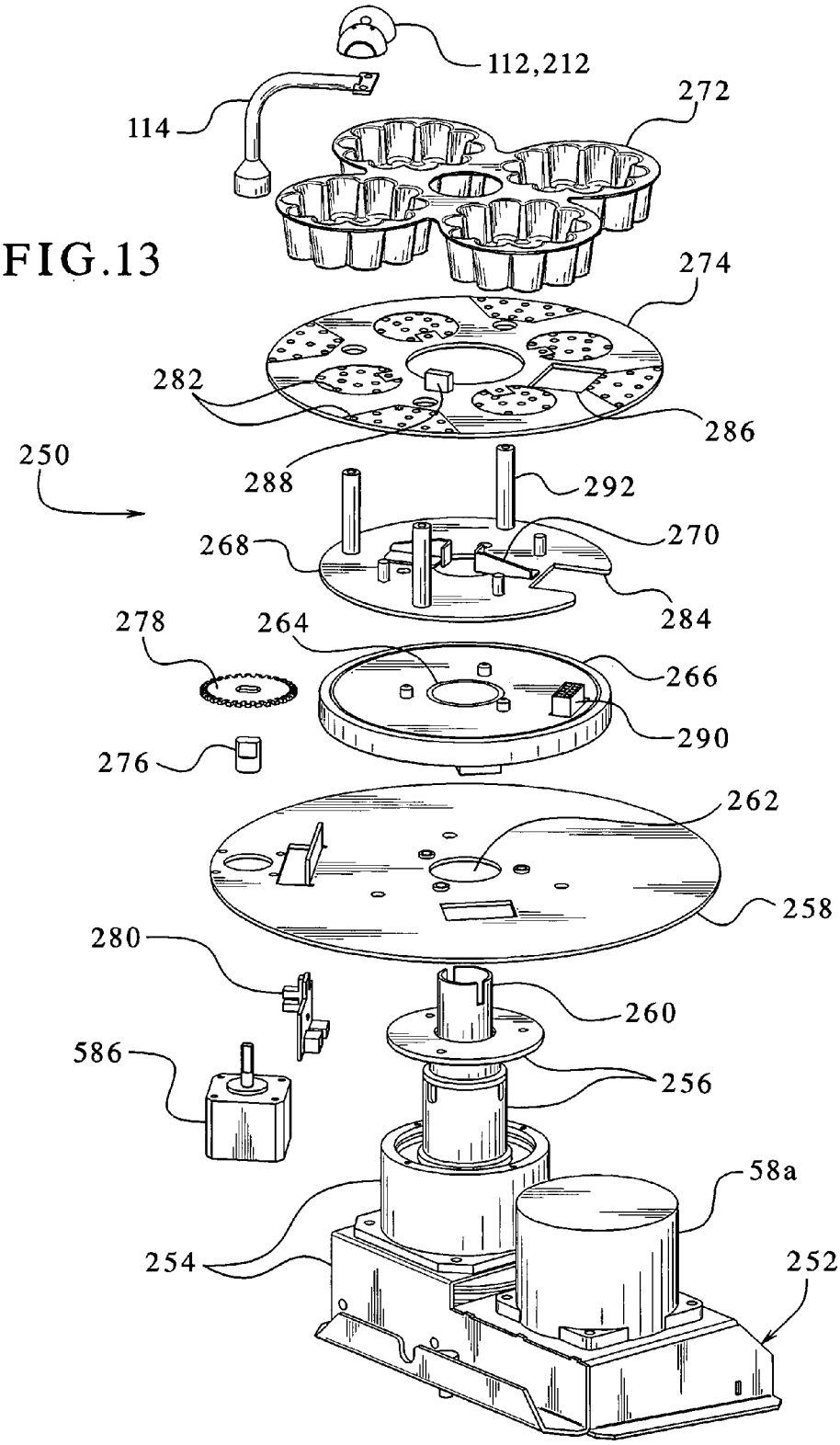
FIG. 13 is an exploded perspective view of the assembly shown in FIGS. 9 to 12.

Referring now to FIGS. 9 to 13, one preferred embodiment for producing the multiple orbiting motion is illustrated by assembly 250. FIGS. 9 to 12 are various perspective views of assembly 250 as assembled. FIG. 13 is a perspective exploded view of assembly 250. Assembly 250 includes a main motor drive sub-assembly 252. Sub-assembly 252 houses the motion producing device 58*a* that produces the major orbiting motion of indicator 112, 212. Motion producing device 58*a* is coupled via a gear box/gear 254 to a rotating drive shaft 256. Gear box or gear 254 can have or produce any suitable ratio with the output of motion producing device 58*a*. Gear box/gear 254 can increase the output speed of motion producing device 58*a* or more likely reduce the rotational speed of output shaft 58*a* and increase torque applied to rotating drive shaft 256 and drive plate 258. Drive shaft 256 and drive plate 258 rotate due to the output of motion producing device 58*a*.

A fixed (non-rotating) hollow shaft 260 is provided that extends through the center of drive shaft 256. A wire harness (not illustrated) is extended through fixed shaft 260 via a hole 262 defined by rotating drive plate 258, and a hole 264 defined by a slip ring 266. The wire harness connects finally to a fixed plate 268 through an aperture 270. Drive plate 258 couples to and moves with rotating drive shaft 256. Fixed plate 270 is coupled to fixed shaft 260. Slip ring 266 is coupled to and rotates with drive plate 258.

A light barrier 272 and a printed circuit board 274 for lighting are each held to pins 292 extending from fixed plate 268. Assembly 250 it should be appreciated includes a fixed or non-moving sub-assembly that having fixed shaft 260, fixed plate 268, PCB or light board 274 and light barrier 272. Assembly 250 also includes a sub-assembly that rotates about the major axis produced by first motion producing device 58*a*. The rotating sub-assembly includes rotating drive, shaft 256, rotating plate 258, slip ring 266, second motion producing device 58*b*, arm 114, indicator 112/212, and miscellaneous items including a motor shaft coupler 276 that couples the output shaft of motion producing device 58*b* to arm 114. Motor output shaft coupler 276 also carries a position outputting device 278. Position outputting device 278 rotates therefore with the output shaft of motion producing device 58*b*. The motion outputting device 278 in one embodiment includes a series of gear teeth that are sequentially sensed by a sensor, such as an optical, capacitive or inductive sensor coupled to a small printed circuit board 280. Small printed circuit board 280 also travels with the rotating sub-assembly, e.g., attaches to rotating plate 258.

Printed circuit board 274 includes a plurality of lights 282, such as light emitting diodes ("LEDs"), filament lights, single or multi-colored lights, sequentially lit or permanently lit lights, flashing or solid lights and any combination thereof. The light barrier 272 aids in directing the light towards a front panel (not illustrated) having any desirable indicia placed thereon. Indeed, the bee indicator 112, 212 can be easily switched out along with the front panel (not illustrated) and light barrier 272 to change a theme of the gaming device 10. That feature along with the ability to vary the rotational acceleration, velocity and distance traveled of both the motion producing devices 58*a* and 58*b* results in an interesting, fun and exciting mechanical display that is also very versatile.

Power to the various electrical components on the board is run from the housing of sub-assembly 252 through fixed shaft 260, through aperture 262 in rotating plate 258, through aperture 264 in slip ring 266, through aperture 270 in fixed plate 268 and terminates at a connector on fixed plate 268. A wire harness can then be run from plate 268 through an aperture 284 defined by fixed plate 268 and a mating aperture 286 in printed circuit board 274 and finally to a connector 288 placed on printed circuit board 274. Power is transferred from fixed plate 268 to conductive slip ring 266, which makes a rotating electrical connection with a mating trace or conductive portion (not illustrated) placed on the bottom side of fixed plate 268. A wire harness is then run from a connector 290 on slip ring 266 to a connector on printed circuit board 280. Printed circuit board 280 powers both second motion producing device 58*b* and the positional sensor located on printed circuit board 280. Connector 288 on printed circuit board 274 in turn powers lights, e.g., fiber optic lights 282, located on printed circuit board 274.

Figure 14:
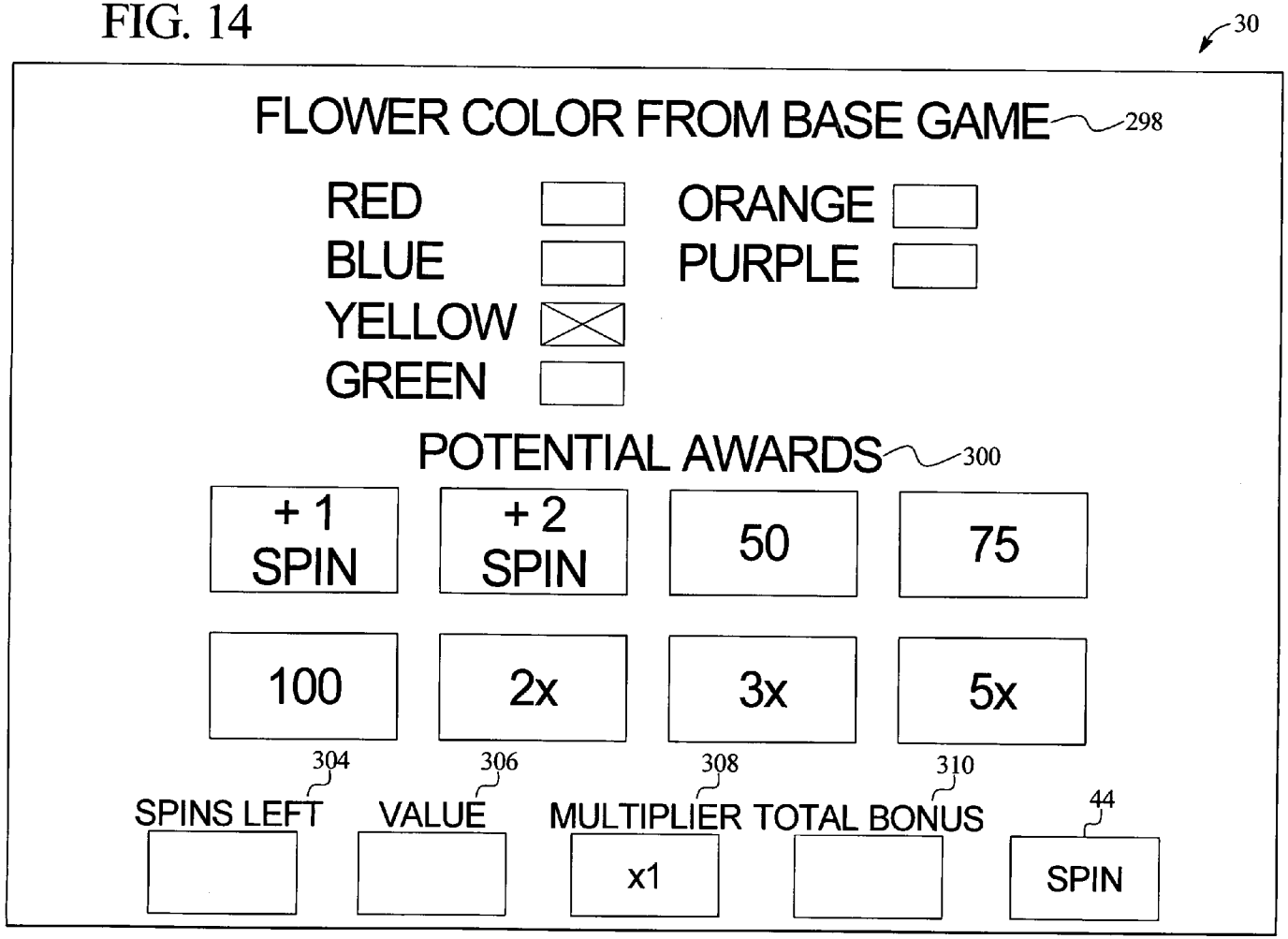
FIG. 14 is an elevation view of a display area of the gaming device illustrating one implementation of the multiple orbiting award indicator or the present invention in a bonus game.

Referring now to FIG. 14, one implementation of the multiple orbiting award indicator of the present invention is illustrated. As discussed above in connection with FIGS. 1A and 1B, gaming device 10, including any of the base games disclosed herein, also includes bonus games that provide players with an opportunity to win additional credits. One use for displays 100 and 200 is for a bonus game. In one implementation, video monitor 30 shown in FIGS. 1A, 1B and 14 is used in combination with displays 100 and 200. Video monitor 30 in one implementation operates with touch screen 50, touch screen controller 52 and video controller 54 to enable the player to interact with the bonus game and displays 100 and 200 of the present invention. In an alternative implementation, electromechanical push buttons or switches are provided, which enable the player to input decisions or selections for the bonus game.

As seen in FIG. 14, a message 298 divides the awards provided by displays 100 and 200 into categories or groups. The awards can be of any of the types discussed above, e.g., credits 102, multipliers 202, free games, etc. 302 and non-monetary awards 402. In the illustrated embodiment, message 298 indicates that the award symbols (e.g., flowers) in displays 100 and 200 are distinguished or grouped by color. In the bonus game, one or more but not all of the colors or types of award symbols is associated with the player.

In one embodiment, gaming device 10 in the base game enables the player to select one or more color or other type of award symbol (e.g., flower) from a set symbols or colors. In another embodiment, gaming device 10 in the bonus game enables the player to select the one or more color or type of award symbol. For example, an input device can be provided on the screen in FIG. 14 that enables the player to select a type or color of award symbol.

In a further embodiment, gaming device 10 randomly generates the type(s) or color(s) of awards to be associated with the player. For example, a symbol(s) in a base slot game that appears on an active payline and triggers the bonus can display and select one of the colors or types from the set of colors or types of award symbols. Further alternatively, the player's associated type or color of symbol is generated randomly in the bonus game.

In other alternative embodiments, the player's associated symbol type or color is based on the player's wager, a component of the player's wager, a result in the base game, a result in a preliminary bonus game, or any feasible combination thereof. In certain instances, one color or type of award symbol is more desirable with respect to at least one other type or color. Otherwise, each category or type of symbol is equally weighted, for example, appears a same number of times on display 100 or 200.

In the illustrated example, the type or color of symbol associated with the player is the yellow symbol 102, 202, 302 or 402. In the illustrated embodiment, the player presses a spin button 44 to initiate the multiple orbiting display 100 or 200 of the present invention. If the indicator 112 (or 212) indicates a symbol 102 (202, 302 and 402 also possible for indicator 212 of FIG. 4) corresponding to the type or color associated with the player (e.g., a yellow flower), the player obtains an additional award 300 shown in FIG. 14. As illustrated, bonus awards 300 include additional spins, credit values and multipliers. Any suitable type of bonus award 300 may be provided.

Screen 30 of FIG. 14 also displays a series of meters and input devices. A spins remaining meter 304 shows the player how many spins or plays of the display 100 or 200 remain. A value meter 306 totals the credits accumulated from credit symbols 102 in FIGS. 3 and 4 as well as from the bonus awards 300 in FIG. 14. Likewise, a multiplier meter 308 accumulates each of the multipliers 202 obtained from display 200 or the bonus multipliers 300 obtained from the awards in FIG. 14. Multiplier meter 308 shows at least a 1× multiplier as seen in FIG. 14.

A total bonus display 310 shows the product of the total credit value in meter 306 after all spins have been exhausted multiplied by the total accumulated multiplier in meter 308 after all spins have been exhausted. The amount ultimately shown in total bonus meter 310 is provided to the player as an overall award from playing the bonus game employing displays 100 or 200. In an alternative embodiment, the game of FIG. 14 and displays 100 and 200 is a stand alone wagering game, in which meter 310 is instead a total base game outcome meter.

To initiate the display 100 or 200 in the game of FIG. 14, the player presses spin button 44. Spin button 44 sends a command to processor 38 to initiate motion controller 56 to cause motion producing device 58 to spin multiple orbiting display 100 or 200. If the indicator 112 or 212 ultimately indicates a symbol of a type associated with the player as determined via one of the methods discussed above, the player wins not only the outcome of display 100 or 200 but also one of the potential awards 300 shown in FIG. 14. The player continues to press the spin button 44 causing display 100 or 200 to operate and repeating the above described process until each of the spins in spin meter 304 is exhausted. At that point, the player's total bonus or total award is tallied in meter 310 and provided to the player.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A gaming device operated under control of a processor, said gaming device comprising:

a game controlled by the processor and operable upon a wager;

a cabinet;

a display device controlled by the processor and configured to display the game, said display device supported by the cabinet;

a display area supported by the cabinet, said display area including a plurality of displayed symbols;

a member rotatable about a first axis, the member having a free end;

a first motion producing device configured to rotate the member about the first axis;

an indicator coupled to the free end of the member, the indicator rotatable about a second axis positioned at the free end of the member, said indicator moveable relative to the displayed symbols, wherein the second axis is substantially parallel to the first axis;

a second motion producing device configured to rotate the indicator about the second axis; and a memory device which stores a plurality of instructions which when executed by the processor, causes the processor to operate with the member, the first motion producing device, the indicator and the second motion producing device to:

(i) cause the first motion producing device to rotate the member and the indicator about the first axis, (ii) cause the second motion producing device to rotate the indicator about the second axis, the rotation of the indicator about the second axis being independent from the rotation of the indicator about the first axis, (iii) stop the rotation of the member, (iv) stop the rotation of the indicator, (v) cause the indicator to indicate one of the symbols of the display area when the rotation of the member and the indicator stops, and (vi) provide an award to the player based on the symbol indicated by the indicator.

2. The gaming device of claim 1, wherein the first motion producing device is coupled to the second motion producing device.

3. The gaming device of claim 1, wherein at least one of the first and second motion producing devices is a stepper motor.

4. The gaming device of claim 1, wherein the first and second motion producing devices are coupled to one another via a gear.

5. The gaming device of claim 1, wherein at least one of the first and second motion producing devices is powered via at least one rotating electrical contact.

6. The gaming device of claim 1, wherein when executed by the processor, the plurality of instructions cause the processor, for at least a period of time, to simultaneously cause: (i) the member to rotate relative to the cabinet, and (ii) the indicator to rotate relative to the member.

7. The gaming device of claim 1, wherein when executed by the processor, the plurality of instructions cause the processor to simultaneously cause: (a) rotation of one of: (i) the member relative to the cabinet, and (ii) the indicator relative to the member to rotate, and (b) no rotation of the other of: (i) the member relative to the cabinet, and (ii) the indicator relative to the member.

8. The gaming device of claim 1, wherein when executed by the processor, the plurality of instructions cause the processor to simultaneously cause: (a) clockwise rotation of one of: (i) the member relative to the cabinet, and (ii) the indicator relative to the member, and (b) counterclockwise rotation of the other of: (i) the member relative to the cabinet, and (ii) the indicator relative to the member.

9. The gaming device of claim 1, wherein the indicator is a first indicator and the free end is a first free end, and which includes a second member having a second free end; and a second indicator coupled to the second free end of the second member, wherein when executed by the processor, the plurality of instructions cause the processor to cause the second indicator to rotate about a third axis positioned at the second free end of the second member.

10. The gaming device of claim 1, wherein when executed by the processor, the plurality of instructions cause the processor to cause the indicator to stop directly over one of the symbols to indicate said symbol.

11. The gaming device of claim 1, wherein when executed by the processor, the plurality of instructions cause the processor to cause the indicator to stop directly adjacent to one of the symbols to indicate said symbol.

12. The gaming device of claim 1, wherein when executed by the processor, the plurality of instructions cause the processor to cause the indicator to stop and point to one of the symbols to indicate said symbol.

13. The gaming device of claim 1, wherein the display area is located on the cabinet in combination with a base game selected from the group consisting of: slot, poker, keno, blackjack, craps and bunco.

14. The gaming device of claim 1, wherein when executed by the processor, the plurality of instructions cause the processor to: (i) initiate a play of a bonus game upon an occurrence of a triggering event in association with a base game selected from the group consisting of: slot, poker, keno, blackjack, craps and bunco, and (ii) cause the member and the indicator to rotate during the play of the bonus game.

15. The gaming device of claim 1, wherein the award is selected from the group consisting of: game credits, a multiplier of credits, a number of picks from a prize pool, a number of free spins, a number of free games, a bonus game and a non-monetary award.

16. A gaming device operated under control of a processor, said gaming device comprising:

a game controlled by the processor and operable upon a wager;

a cabinet;

a display device controlled by the processor and configured to display the game, said display device supported by the cabinet;

a display area supported by the cabinet, the display area including a plurality of displayed symbols, the display area defining a slot;

a member having an end which extends through the slot;

an indicator coupled to the end of the member, said indicator moveable relative to the displayed symbols;

a first motion producing device configured to rotate the member about an axis;

a second motion producing device coupled to the member and rotatable by the first motion producing device about the axis, the second motion producing device configured to rotate the indicator about the member, wherein the indicator is configured to indicate one of the symbols when rotation of the member stops; and a memory device which stores a plurality of instructions which when executed by the processor, causes the processor to operate with the member, the indicator, the first motion producing device and the second motion producing device to:

(i) cause the first motion producing device to rotate the member and the indicator about the axis, (ii) cause the second motion producing device to rotate the indicator about the member, the rotation of the indicator about the member being independent from the rotation of the indicator about the axis, (iii) stop the rotation of the member, (iv) stop the rotation of the indicator, (v) cause the indicator to indicate one of the symbols when the rotation of the member and the rotation of the indicator stops, and (vi) provide an award to the player based on the symbol indicated by the indicator.

17. The gaming device of claim 16, wherein the member is a first member, and wherein the indicator is coupled to the end of the first member via a second member, the second member sized so that the indicator can move to indicate the award symbols.

18. The gaming device of claim 17, wherein the first and second motion producing devices are coupled to one another via a gear.

19. The gaming device of claim 16, wherein the second motion producing device is powered via at least one rotating electrical contact.

20. The gaming device of claim 18, wherein the display area includes an apparatus that is configured to hide at least a portion of the slot from a view of a player.

21. The gaming device of claim 20, wherein the apparatus is associated with the award symbols.

22. The gaming device of claim 20, wherein the slot forms an enclosed path for the member to move while rotating about the axis.

23. The gaming device of claim 20, wherein the slot forms a substantially enclosed path for the member to move while rotating about the axis, the slot being interrupted by a tab that connects a first sub-area of the display area substantially surrounded by the slot to a second sub-area positioned outside the slot.

24. A gaming device operated under control of a processor, said gaming device comprising:

a game controlled by the processor and operable upon a wager;

a cabinet;

a display device controlled by the processor and operable to display the game, said display device supported by the cabinet;

an indicator rotatable relative to a plurality of symbols displayable by a display area;

a first motion producing device coupled to the indicator, the first motion producing device configured to rotate the indicator about a first axis such that the indicator moves in a first orbit about the display area, the display area being stationary relative to the indicator;

a second motion producing device coupled to the indicator, the second motion producing device moveable about the first axis due to the rotation of the indicator about the first axis by the first motion producing device, the second motion producing device configured to rotate the indicator about a second axis such that: (i) the indicator is moveable in a second, different orbit about the second axis when the second motion producing device is moved to a first position about the first axis by the first motion producing device, and (ii) the indicator is moveable in a third, different orbit about the second axis when the second motion producing device is moved to a second, different position about the first axis by the first motion producing device, the second axis being parallel to the first axis and the second, different orbit intersecting the third, different orbit; and a memory device which stores a plurality of instructions which when executed by the processor, causes the processor to operate with the first motion producing device, the indicator and the second motion producing device to:

(i) cause the first motion producing device to rotate the indicator about the first axis, (ii) cause the second motion producing device to rotate the indicator about the second axis, (iii) stop the rotation of the indicator about the first axis, (iv) stop the rotation of the indicator about the second axis, (v) cause the indicator to indicate one of the symbols of the display area when the rotation of the indicator stops about the first axis and when the rotation of the indicator stops about the second axis, and (vi) provide an award to the player based on the symbol indicated by the indicator.

25. The gaming device of claim 24, which includes a rotating member, wherein the first motion producing device is coupled to the indicator via the rotating member, the rotating member including at least one of a rotating plate, a drive shaft and a slip-ring conductor.

26. The gaming device of claim 25, which includes a fixed member, wherein the fixed member is configured to hold the display area stationary relative to the indicator, the fixed member extending through the rotating member, the fixed member including at least one of a fixed shaft, a fixed plate and a light barrier.

27. The gaming device of claim 25, wherein the first motion producing device is coupled to the rotating member via one of a gear, at least one right-angled linkage and a belt and pulley.

28. The gaming device of claim 26, which includes an electrical connection between the fixed member and the rotating member.

29. The gaming device of claim 26, wherein electrical power is conducted to the fixed member to power at least one light connected to the fixed member.

30. The gaming device of claim 25, which includes a positioning sensor carried by the rotating member, wherein the positioning sensor is configured to sense a position of the indicator about the axis.

31. The gaming device of claim 25, which includes a positioning sensor positioned and arranged to sense the position of the indicator about the display area.

32. The gaming device of claim 31, wherein the positioning sensor senses a position of one of: (i) an output shaft of the first motion producing device, (ii) a gear coupled to the first motion producing device, and (iii) the rotating member.

33. A method of operating a gaming device including a plurality of instructions, said method comprising:

(a) causing a display device to display a game upon a wager by a player;

(b) causing a processor to execute the plurality of instructions to cause:

(i) a first motion producing device to rotate a member having a distal end about a first axis relative to a plurality of symbols, and (ii) a second motion producing device to rotate an indicator about a second axis positioned at the distal end of the member, relative to the plurality of symbols, the rotation of the indicator about the second axis being independent from the rotation of the indicator about the first axis;

(c) causing the first motion producing device and the second motion producing device to stop the rotation of the member and the indicator;

(d) causing the indicator to indicate one of the plurality of symbols when the rotation of the member and indicator stops; and (f) causing the processor to execute the plurality of instructions to provide an award to the player, the award based on the indicated symbol.

34. The method of claim 33, which includes masking the member and the rotation thereof from a player.

35. The method of claim 33, which includes causing at least one of the first motion producing device and the second motion producing device to change an angular direction of rotation of at least one of the member and indicator at least one time.

36. The method of claim 33, which includes causing at least one of the first motion producing device and the second motion producing device to change an angular velocity of at least one of the member and indicator at least one time.

37. The method of claim 33, which includes causing at least one of the first motion producing device and the second motion producing device to change an angular acceleration of at least one of the member and indicator at least one time.

38. The method of claim 33, which includes causing at least one of the first motion producing device and the second motion producing device to change an angular deceleration of at least one of the member and indicator at least one time.

39. A method of operating a gaming device including a plurality of instructions, said method comprising:

(a) causing a display device to display a game upon a wager by a player;

(b) causing a processor to execute the plurality of instructions to simultaneously cause:

(i) a first motion producing device to rotate an indicator about a first axis through a first orbit about a plurality of symbols, and (ii) a second motion producing device to rotate the indicator about a second axis through one of a plurality of different second orbits relative to the symbols, at least one of the second orbits intersecting another one of the second orbits;

(c) causing the first motion producing device and the second motion producing device to stop the rotation of the indicator;

(d) after stopping the rotation of the indicator, causing the indicator to indicate one of the symbols; and (e) causing the processor to execute the plurality of instructions to provide an award to the player, the award based on the indicated symbol.

* * * * *

UNITED STATES PATENT AND TRADEMARK OFFICE

CERTIFICATE OF CORRECTION

PATENT NO. : 7,731,580 B2
APPLICATION NO. : 10/958494
DATED : June 8, 2010
INVENTOR(S) : Markus Rothkranz It is certified that error appears in the above-identified patent and that said Letters Patent is hereby corrected as shown below:

In Claim 33, Column 18, line 1, replace "(f)" with --(e)--.

Signed and Sealed this

Third Day of August, 2010

David J. Kappos

David J. Kappos
*Director of the United States Patent and Trademark Office*